US005848485A

United States Patent [19]

Anderson et al.

[11] Patent Number: 5,848,485

[45] Date of Patent: Dec. 15, 1998

[54] SYSTEM FOR DETERMINING THE POSITION OF A TOOL MOUNTED ON PIVOTABLE ARM USING A LIGHT SOURCE AND REFLECTORS

[75] Inventors: Robert Allen Anderson, Beavercreek, Ohio; Jan Bos, XH Maasland; Ronald Peter Krom, MS Voorhout, both of Netherlands

[73] Assignee: Spectra Precision, Inc., Dayton, Ohio

[21] Appl. No.: 774,203

[22] Filed: Dec. 27, 1996

[51] Int. Cl.[6] ..... E02F 5/02

[52] U.S. Cl. ..... 37/348; 701/50; 356/141.1

[58] Field of Search ..... 37/348, 382, 414–416; 172/2, 4, 4.5; 701/50; 356/3.01, 400, 141.1

[56] References Cited

U.S. PATENT DOCUMENTS

| | | | |
|---|---|---|---|
| 3,997,071 | 12/1976 | Teach . | |
| 4,129,224 | 12/1978 | Teach . | |
| 4,288,196 | 9/1981 | Sutton, II . | |
| 4,393,606 | 7/1983 | Warnecke . | |
| 4,888,890 | 12/1989 | Studebaker et al. . | |
| 4,895,440 | 1/1990 | Cain et al. | 356/5 |
| 5,000,564 | 3/1991 | Ake | 356/1 |
| 5,076,690 | 12/1991 | deVos et al. . | |
| 5,100,229 | 3/1992 | Lundberg et al. | 356/1 |
| 5,110,202 | 5/1992 | Dornbusch et al. | 356/1 |
| 5,177,489 | 1/1993 | Hatch | 342/357 |
| 5,301,005 | 4/1994 | deVos et al. . | |
| 5,375,663 | 12/1994 | Teach | 172/4.5 |
| 5,438,771 | 8/1995 | Sahm et al. | 172/7 X |
| 5,579,102 | 11/1996 | Pratt et al. | 356/3.12 |
| 5,600,436 | 2/1997 | Gudat | 172/4.5 X |
| 5,666,792 | 9/1997 | Mullins | 172/4.5 X |

*Primary Examiner*—Terry Lee Melius
*Assistant Examiner*—Victor Batson
*Attorney, Agent, or Firm*—Killworth, Gottman, Hagan & Schaeff, L.L.P.

[57] ABSTRACT

The present invention is an apparatus and method for accurately determining the position of a tool, for example an earthmoving bucket, mounted at the end of an arm which has a plurality of pivot points and is pivotally attached to the base of a machine, for example a piece of construction equipment like the platform of an excavator or other earthmoving machine. The present apparatus includes a plurality of reflectors mounted on the machine for indicating movement of the arm and the tool. Each reflector is operatively adapted for reflecting light back toward a light source. A light transceiver is mounted on the machine in a known relationship to the reflectors. The light transceiver is operatively adapted for transmitting a beam of light to illuminate each of the reflectors, thereby generating reflective light. The light transceiver detects the reflective light and the angular orientation of the reflective light it detects. The light transceiver is also adapted to generate an output signal in response to the reflective light and the angular orientation it detects. A computer computes the position of the tool using the output signals of the light transceiver generated in response to the reflected light and the angular orientation of the reflected light. The present position determining system is relatively simple in construction, inexpensive and readily installed, including on construction equipment like various types of conventional earthmoving machines.

28 Claims, 4 Drawing Sheets

SYSTEM FOR DETERMINING THE POSITION OF A TOOL MOUNTED ON PIVOTABLE ARM USING A LIGHT SOURCE AND REFLECTORS

FIELD OF THE INVENTION

The present invention relates generally to a system used in controlling the operation of a pivotable arm mounting a tool, more particularly, to a laser based system for determining the position of a tool mounted on the pivotable arm of a machine and, even more particularly, to a laser based system and method where a laser transceiver and a plurality of laser light reflectors are mounted on the machine for determining the position of such a tool.

BACKGROUND OF THE INVENTION

Laser-based systems have been used in various position control applications. For example, laser-based systems have been increasingly utilized in the construction industry to control the operation of earthmoving equipment, such as the digging depth of an excavating machine. One such system is disclosed in U.S. Pat. No. 3,997,071 issued to Teach. In this system, angle transducers are mounted between each of the major pivotal axes to measure the angles between an outreach boom and the horizontal, the outreach boom and a downreach boom, and the downreach boom and a line drawn to the digging teeth of the bucket. This angular information is then processed in accordance with trigonometric equations to provide a continuous indication of the depth of the digging teeth of the bucket relative to the mounting axis of the outreach boom.

The absolute depth of the digging teeth may be determined by measuring the elevation of the mounting axis of the outreach boom relative to a reference plane defined by a rotating laser beam. A moveable mast mounted on the mounting axis of the downreach boom has a beam sensor which is continually adjusted such that a defined section of the beam sensor is impinged by the rotating laser beam. Movement of the mast is monitored to determine the elevation of the mounting axis of the outreach boom for which the absolute elevation of the digging teeth of the digging bucket can be determined and displayed.

An improved laser-based excavating control system is disclosed in U.S. Pat. No. 4,129,224 also issued to Teach. In this system, the angles between the pivotally mounted elements of the excavating machine are monitored by angle transducers. The angle measurements are applied to a series of trigonometric equations to control the attack angle of the digging teeth of the digging bucket. The digging teeth of the digging bucket are thereby controlled to move parallel to a desired slope of an excavation throughout the digging stroke.

A further advance in laser controlled excavating systems is disclosed in U.S. Pat. No. 4,888,890 issued to Studebaker et al. The Studebaker system utilizes a moveable mast mounted on an outreach boom of the excavating machine. The mast is maintained in a vertical position by an alignment device, such as a pendulum device or parallelogram control linkage system. The moveable mast is also continually displayed along its vertical axis such that a beam sensor mounted thereon engages a reference plane of laser light. By monitoring the movement of the mast, the position of the impinging plane of laser light relative to the mast can be determined. Angle sensors monitor the angles between the pivotally mounted elements of the excavating machine. This data is then processed in accordance with trigonometric equations to determine and display continuously the digging depth of the bucket relative to a desired grade. In addition, a tilt sensor may be mounted on the excavator cab to compensate for any side-to-side slope of the excavating machine.

Unfortunately, each of the above described laser-based systems are relatively expensive and complicated. Due to the complexity of these systems, they are difficult to install on typical excavator-type earthmoving machines. Their complexity also makes these prior systems susceptible to premature failure, especially when used under the adverse working conditions often encountered at a construction site, in particular, the working conditions typically encountered by an earthmoving excavator. In addition, to provide accurate control of the digging depth of the bucket, each component of such complex systems has to be extremely accurate. Furthermore, the accuracy and speed of prior art systems using a laser beam sensing mast is reduced because of the various means used to maintain the mast in a vertical position.

Accordingly, there is a need for an improved system for determining the position of a tool mounted at the end of a pivotable arm, for example the bucket mounted on the boom of an earthmoving machine, where the system accurately determines the position of the tool while still being of relatively simple construction, inexpensive, rugged and readily installed.

SUMMARY OF THE INVENTION

In response to this need, the present invention is broadly directed to an apparatus and method for accurately determining the position of a tool mounted at the end of a pivotable arm forming part of a machine, for example, a bucket or other construction tool mounted on an arm which is pivotally attached to a piece of construction equipment, such as the base or platform of a high lift concrete pump and different earthmoving machines, including, but not limited to, various types of excavators, shovels and front-end loaders. The present position determining system is of relatively simple construction, inexpensive, rugged and readily installed, even on construction equipment located outdoors at a job site. Throughout the specification, the present invention is described with regard to the particular application of controlling the position of a bucket on an earthmoving machine. However, the present invention is not intended to be so limited; such description is for the purpose of example only.

The present invention can be used on a number of different types of machines. These machines generally share the common features of an arm having a plurality of pivot points with a rear end pivotally attached to a base or platform at one pivot point and a leading end pivotally attached to a tool, such as a bucket, at another pivot point. At least one actuating mechanism can be used for pivotally moving the arm and the tool. In one aspect of the present invention, an apparatus for determining the position of the tool on such a machine includes a plurality of light reflectors mounted in a known relationship on at least one of the platform, the arm and the tool of the machine for indicating movement of the arm and the tool. Each reflector is operatively adapted for reflecting light back toward a light source.

A light transceiver is mounted on the machine in a known relationship to the reflectors. The light transceiver is operatively adapted for transmitting a beam of light to illuminate each of the reflectors and thereby generate reflected light from each reflector. The light transceiver is also adapted to detect the reflected light from each of the reflectors and to detect the angular orientation of this reflective light. The light transceiver is further adapted to generate at least one output signal in response to its detecting the reflected light from each reflector and the corresponding angular orientation. A computer determines the position of the tool using the output signals from the reflectors. It is desirable for the computer to compute the position of the tool by determining the geometric relationship between the various reflectors, using the output signals.

In one embodiment, the light transceiver is a laser light transceiver, in particular, the kind that transmits a rotating beam of laser light, forming a plane of laser light, that illuminates each of the reflectors sequentially. One way of determining the geometric relationship between the reflectors is to adapt the transceiver to detect the angular orientation of each reflected beam of light, and thus of each reflector, relative to a known index position (i.e., the angle between an index position and the reflected light for each reflector). For such a transceiver, the index position is along the rotation of the beam of light. The orientation of the arm, and therefore the position of the tool, can be determined by knowing the angular relationship between the reflectors, where each reflector and the transceiver are mounted on the machine, and the geometry of the machine.

As long as each of the reflectors remains in position across the plane of laser light, the position of the tool can be determined regardless of whether the plane in which the arm operates is vertically, horizontally or otherwise oriented (i.e., slanted). If the sequence in which each reflector is illuminated varies during the operation of the machine, then each reflector may need to be operatively adapted for encoding the light it reflects in order to uniquely identify each reflector to the computer. However, the need for encoding the reflected light can be avoided by positioning the laser transceiver and reflectors so that the reflectors are illuminated in the same sequence for each rotation of the beam of light, throughout the operation of the machine.

It is desirable for each of the reflectors and for the light transceiver to be mounted on the machine in a known geometric relationship to at least one of the pivot points of the arm. The computer can then be adapted to compute the position of the tool using the known geometric relationship between the light transceiver, the reflectors and the pivot points. Alternatively, for some applications, it may be desirable for the computer to determine the position of the tool by having all, or a portion, of the possible transceiver output signals and the corresponding tool locations stored in its memory, such as in a look-up table, rather than actually computing the positions of the tool.

Whether the light transceiver is mounted on the arm or elsewhere on the machine depends, at least in part, upon the particular type of machine having its tool monitored. In either case, it is desirable to locate the light transceiver on the machine within each circle described, at least in part, by the movement of those reflectors which are rotatable about at least one of the pivot points associated with the arm. When the light transceiver is so positioned on a machine with an arm having a plurality of rotatable arm segments, the angle of each arm segment can be uniquely defined by a single angle measurement computed from the light transceiver output.

The present invention can be used with an automatic or manually operated machine. To aid an operator in controlling the position of the tool, it is desirable for the present system to include some kind of a display for graphically, pictorially or otherwise visually indicating the position of the tool in response to the position computations performed by the computer.

The present invention can be operatively adapted to determine the location of the machine relative to a spacial reference point. For example, by measuring or otherwise knowing the elevation of an earthmoving machine relative to a reference grade elevation, the computer can be adapted to compute the position of the earthmoving bucket relative to the reference grade elevation. When the earthmoving machine is being operated with its platform at the same distance above the grade elevation, the position of the bucket relative to this grade elevation can be determined by simply measuring the distance between the platform and the grade elevation. The computer then utilizes this measured distance in computing the position of the bucket relative to the grade elevation.

However, many of the machines which can use the present invention do not stay a fixed distance from a given reference point when operated. For example, earthmoving machines typically do not remain the same distance above a reference grade elevation as they move around at a job site. In such situations, other ways of obtaining this elevation measurement are necessary. For example, this elevation measurement can be obtained using a level reference laser system or a global positioning system (GPS), each of which is well known and, therefore, described in only limited detail herein.

The arm of some machines includes a first arm segment and a second arm segment. The first arm segment has a rear end pivotally attached to a base or platform at a first pivot point and a leading end pivotally attached to a rear end of the second arm segment at a second pivot point. The leading end of the second arm segment is then pivotally attached to the tool at a third pivot point. One tool position determining system that can be used with this type of machine includes at least one first reflector mounted on the machine. It is desirable for two first reflectors to be used, with each first reflector indicating rotational movement of the first arm segment about the first pivot point. When two first reflectors are used, it has been found desirable for one of the first reflectors to be mounted at an elevated position above the other first reflector. In addition, a second reflector is mounted on the arm for indicating movement of the second arm segment. Furthermore, a third reflector is mounted on the arm for indicating movement of the tool. For such a machine, it has been found desirable for one first reflector to be mounted at an elevated position above the first pivot point, another first reflector to be mounted adjacent to the first pivot point, the second reflector to be mounted so as to rotate with the second arm segment, and the third reflector to be mounted to move as the bucket rotates about the third pivot point.

The present system for determining the position of a bucket, or other tool, exhibits a number of advantages. For instance, the present invention can use position measuring components (e.g., the light reflectors) of relatively simple and rugged construction at those locations on the arm, such as its leading end, which are exposed to the greatest risk of being damaged. In this way, the present invention is capable of withstanding the adverse working conditions often encountered in many applications, such as the working conditions of an earthmoving excavator at a construction site.

It is believed that the present invention is also capable of determining the position of the tool with an accuracy of up to approximately ±1 cm, at least in part, because it can employ laser technology in its position measuring.

In addition, the present system is simple to install, even on construction equipment, such as conventional earthmoving machines, and simple to set up at a job-site, even outdoors.

Furthermore, the present system can be used with a variety of machines which have a tool mounted on a pivotable arm, including different types of construction equipment and robotic arms.

The present invention can be used with such a pivotable arm regardless of the angle of the plane the arm moves in.

The objectives and features as well as other advantages of the present invention become apparent upon consideration of the instant specification and drawings.

DETAILED DESCRIPTION OF THE INVENTION

The present invention is broadly directed to an apparatus and method for accurately determining the position of a tool mounted at the end of a pivotable arm forming part of a machine. By way of example, the present invention is herein described in terms of its use on one form of an earthmoving machine, an excavator 10. It is understood that the principles of the present invention are also applicable for use with other types of earthmoving machines including shovels and front-end loaders, construction equipment including high-lift concrete pumps, and other machines employing an arm pivotally mounted to a base at one end and mounting a tool at its other end. The present invention can be utilized regardless of whether the machine is mobile or fixed in place. In addition, upon reading the present specification, it will be readily apparent to those skilled in this art that various modifications, re-arrangements, and substitutions can be made to the disclosed and other embodiments of the present invention without departing from the spirit of the invention. The scope of the present invention is thus only limited by the claims appended hereto.

Figure 1:
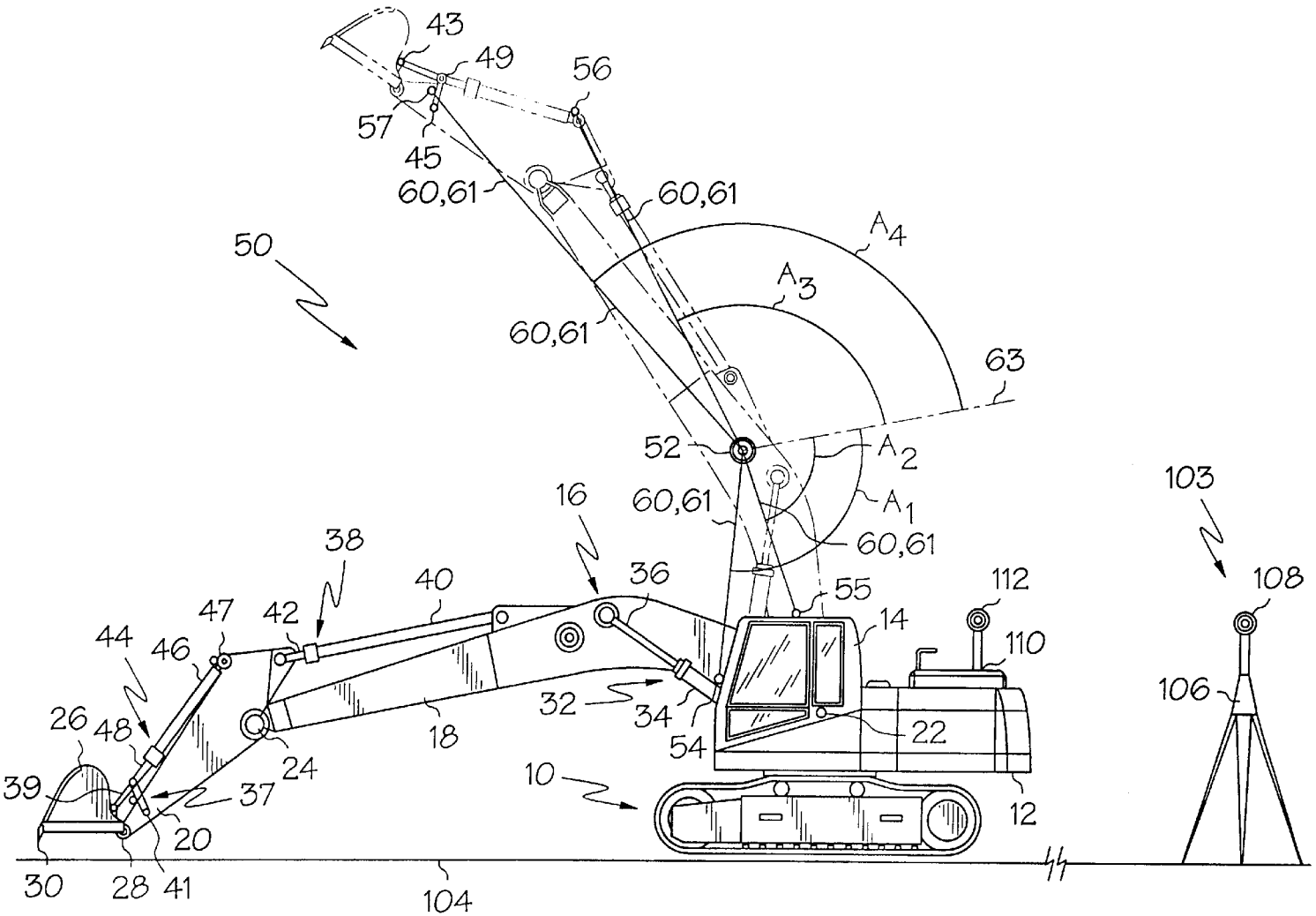
FIG. 1 is a side view of an earthmoving excavator mounting a tool position determining apparatus according to the present invention, with the excavator arm shown in two configurations.
Figure 2:
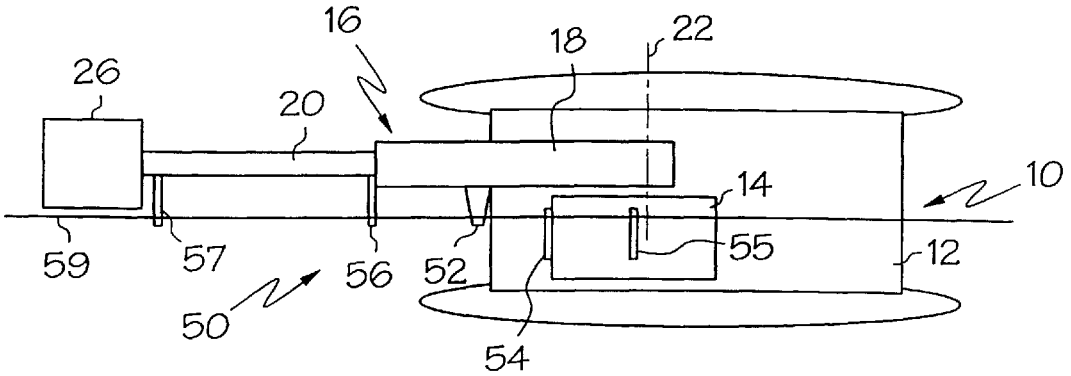
FIG. 2 is a top schematic view of the earthmoving excavator of FIG. 1, with its tool position determining apparatus mounted thereto.

Referring to FIGS. 1 and 2, the excavator 10 is of the full-track variety and includes a base or platform 12, a cab 14 fixedly mounted on the platform 12 and a segmented arm 16 pivotally attached to and extending out beyond the platform 12. In FIG. 1, arm 16 is shown in a forward extended configuration and (in phantom) in a raised extended configuration. Arm 16 has an elbow shaped first arm segment or boom 18 and a second arm segment or dipper stick 20. The rear end of the boom 18 is pivotally attached to platform 12 at a first pivot point or axis 22 (shown hidden behind the cab 14) and its leading end is pivotally attached to the rear end of stick 20 at a second pivot point or axis 24. A tool or bucket 26 is pivotally attached to the leading end of stick 20 at a third pivot point or axis 28. The bucket 26 has a set of teeth 30 positioned along its leading edge for digging into the earth.

At least one actuating mechanism or first hydraulic cylinder unit 32 is used to pivot the boom 18 about point 22. Unit 32 has a cylinder 34 with a rear end pivotally attached to the platform 12 and a rod 36 with a leading end pivotally attached to the boom 18. A second cylinder unit 38 for pivoting stick 20 about point 24 has a cylinder 40 with a rear end pivotally attached to the boom 18 and a rod 42 with a leading end pivotally attached to the stick 20. A third cylinder unit 44 is used to pivot the bucket 26 about the point 28. Cylinder unit 44 has a cylinder 46 with a rear end pivotally attached to the stick 20 at a fourth pivot point or axis 47 and a rod 48 with a leading end pivotally attached to a conventional bucket mechanism 37 at a fifth pivot point or axis 49. The bucket mechanism 37 includes a pair of first legs 39 disposed between a pair of second legs 41. One end of each leg 39 and 41 is mounted for rotation to the end of rod 48 along the pivot axis 49. The other end of each leg 39 is mounted for rotation to the back of the bucket 26 at a sixth pivot point or axis 43, and the other end of each leg 41 is mounted for rotation near the leading end, one on either side, of the stick 20 at a seventh pivot point or axis 45.

One embodiment of an apparatus 50 for determining the position of the bucket 26, in particular the tip of its teeth 30, according to the principles of the present invention includes a laser light transceiver 52, at least one first laser light retroreflector 54, a second laser light retroreflector 56, and a third laser light retroreflector 57, all mounted on the machine 10. Examples of such a transceiver 52 are disclosed in U.S. Pat. Nos. 5,076,690 and 5,301,005, which are both incorporated herein by reference in their entirety. Each of the reflective targets 54–57 can, for example, be made disposable by being comprised of a thin walled tube (e.g., made of aluminum, PVC fiberglass composite, etc.) having a coating of reflective material on one end and threads on the other end. The threaded end of each such target is screwed into a socket (e.g., made of stainless steel) permanently welded or otherwise mounted to the desired location on the machine 10. If it is ever damaged, this type of target can be unscrewed and replaced. For the particular machine 10 illustrated in FIGS. 1 and 2, it has been found desirable to use two first reflectors 54 and 55, instead of one, to improve the accuracy of the bucket position measurement. The use of two first reflectors 54 and 55 is discussed in further detail later on. For some machines, the use of only one first reflector may be sufficient.

Each of the reflectors or targets 54–57 is operatively adapted for reflecting laser light back toward a light source. The transceiver 52 is operatively adapted for transmitting a rotating beam of laser light 60 to illuminate and thereby generate reflected laser light 61 from each of the reflectors 54–57 during each rotation of the laser beam 60. Laser beam 60 should be of an appropriate size so that the resulting reflected laser light 61 from each of the reflectors 54–57 is able to create discernible START signals and END signals. Since they lie along substantially the same line of travel, the rotating beam of laser light 60 from transceiver 52 and the resulting beam of reflected laser light 61 from each of the reflectors 54–57 are jointly depicted by the same reference line.

The transceiver 52 is also adapted for detecting the reflected laser light 61 and the angular orientation of the reflected laser light 61 from each reflector 54–57. The transceiver 52 is further adapted for generating at least one output signal every time it detects the reflected laser light 61 and its corresponding angular orientation from each reflector 54–57. These output signals from the transceiver 52 are continuously transmitted to a computer 62 which is operatively adapted to determine the position of the bucket 26, in particular the tip of its teeth 30, from the output signals as well as stored data on the geometry of the machine 10 and the locations of the transceiver 52 and reflectors 54–57 on the machine 10. It is desirable for the computer 62 to be mounted on-board the machine 10, but it could also be mounted remote therefrom. The computer 62 includes a microprocessor, such as a Motorola 68233, having a suitable memory for storing the software and data necessary to determine the position of the tip of the bucket teeth 30 from the output signals generated with each rotation of the laser beam 60. A listing of an exemplary software program for performing such a tool position computation, including the angle measurements, in accordance with the present invention is included following the detailed description.

It is envisioned that the tool position determining function of apparatus 50 can be performed by one or more computer elements positioned wholly or partly on or remote from the machine 10. In addition, part or all of the computing function could be incorporated into the transceiver unit 52. For example, all of the output signals (generated in response to the reflected light 61 from each reflector 54–57 and the corresponding angular orientations) that are detected during each revolution of the beam of light 60, could be combined into one signal, with this one signal being sent to another computer element located remote from the transceiver for subsequent computation to determine the position of bucket 26.

Each reflector 54–57 is preferably a passive structure, though active sensors may be used as well. One type of passive reflector envisioned is a simple tubular or solid bar of suitable material having a circular cross-section and an outer surface that is reflective to laser light (e.g., a steel tube of about 2 inches in diameter, with a polished chrome outer surface). The use of such passive reflectors 54–57 reduces the cost and improves the overall ruggedness and service life of the apparatus 50. A reflector of such simple construction will be more difficult to damage to the point of affecting the operation of apparatus 50. Such ruggedness is particularly necessary for the reflector 57 mounted near the bucket 26, because it is the most exposed and vulnerable to being damaged. Such passive reflectors 54–57 can also be easily welded or otherwise attached to the machine 10 to facilitate installation of the apparatus 50.

The optimum placement of the transceiver 52 and reflectors 54–57 will likely vary depending upon the type of earthmoving machine being used. For the purpose of example only, and not by way of limitation, a desirable placement of apparatus 50, for the machine 10 shown in FIGS. 1 and 2, includes mounting the transceiver 52 about half way along boom 18 just after its bend. One first reflector 54 is mounted near the rear end of the boom motion cylinder 34, about half-way up the front of the cab 14. The other first reflector 55 is mounted on the top of the cab 14, in about the middle of its roof and rearward of reflector 54. The second reflector 56 is mounted on the stick 20, near the rear end of the bucket motion cylinder 46. The third reflector 57 is mounted near the leading end of the bucket motion rod 48 so as to move when the bucket 26 is moved. Satisfactory results have been obtained when the third reflector 57 is mounted between the pivot points 45 and 49, on the second leg 41 located on the same side as the transceiver 52. This location has been found particularly desirable for the apparatus setup procedure described further on below. The desirability of the above placement of the transceiver 52 and reflectors 54–57 on a conventional excavator 10 has been proven by using computer simulation, and the results of the computer simulation were verified with actual prototype (i.e., hardware) testing. The reflectors 56 and 57 could be mounted to one end of the pivot pins at pivot points 47 and 49, respectfully. However, the pivot pins used in most earthmoving machines, including excavator 10, often fail while in use and must be replaced. Therefore, it is advisable not to mount any of the reflectors 54–57 directly onto a pivot pin.

By being mounted about half-way up the front of the cab 14, the first reflector 54 becomes invisible to the transceiver 52 (i.e., is no longer in line to reflect the beam of light 60) when the boom 18 is pivoted upward beyond a certain point. At that point, only the first reflector 55 on the top of the cab 14 can be seen by the transceiver 52 (i.e., is able to reflect light beam 60). When this occurs, the transceiver 52 begins to generate output signals from the reflected light 61 from reflector 55. These output signals, resulting from reflector 55, are transmitted to the computer 62 and used to determine the position of the bucket 26, in particular the tip of its teeth 30, as described above.

In the embodiment of apparatus 50 described in detail herein, it is desirable for the output signals from transceiver 52 to be generated only when reflected light 61 is being detected. When the laser beam 60 is not reflecting off of one of the reflectors 54–57, no output signal is generated. The transceiver 52, used in this embodiment of apparatus 50, is the kind that transmits a rotating beam of laser light 60 that forms a plane 59 of laser light so as to illuminate each of the reflectors 54–57 sequentially (see FIGS. 2 and 3). The transceiver 52 transmits a generally vertical plane 59 of laser light substantially parallel to the generally vertical plane in which arm 16 operates (i.e., the plane of the sheet on which FIG. 1 is illustrated). However, for such a transceiver 52, as long as the operating plane of the arm 16 and the plane 59 formed by laser beam 60 remain substantially parallel (i.e., each of the reflectors 54–57 remains in position across the plane 59 of laser light 60), the position of the bucket 26 can be determined regardless of whether the operating plane of the arm 16 is oriented vertically, at an angle, or even horizontally.

If the sequence in which each reflector 54–57 is illuminated varies during the operation of the machine 10, then each reflector 54–57 may need to be operatively adapted for encoding, or otherwise identifying, the light it reflects in order to uniquely identify to the computer 62 which reflector 54–57 each output signal is associated with. However, it is desirable to use simple anonymous reflectors because self-identifying reflectors are typically more expensive to use and less reliable, especially in an earthmoving environment. The need for bar-coded, or otherwise self-identifying, reflectors can be avoided if the reflectors 54–57 remain in position to be illuminated in the same sequence for each rotation of the beam of light 60, throughout the operating range of motion of the arm 16 (i.e., if the angle ranges in which the transceiver 52 can see the reflectors 54–57 do not overlap).

The position of the tip of the bucket teeth 30 relative to the platform 12 of machine 10 can be determined once the orientation of the arm 16 (i.e., of the bucket 26 and arm segments 18 and 20) is known. The orientation of the arm 16 can be determined using conventional mathematical methods, once the dimensions of the machine 10 (in particular the arm 16), the location of the transceiver 52 and each reflector 54–57 relative to the pivot points 22, 24 and 28, and the geometric relationship between the reflectors 54–57 is determined. The dimensions of the machine 10 and the locations of the transceiver 52 and reflectors 54–57 can be measured and stored in the memory of computer 62. As discussed in detail later on, a setup procedure has been developed which can be used to avoid measuring the relative distances and locations of the various components of the apparatus 10 (i.e., transceiver 52 and reflectors 54–57) on a machine 10.

In determining the geometric relationship between the reflectors 54–57, the transceiver 52 may be adapted to detect the angular orientation of each reflected beam of light 61 and thus of each reflector 54–57 relative to a known index position, shown as line 63 in FIG. 1, along the path of rotation of the beam of light 60. That is, the angular orientations detected are the angles $A_1$, $A_2$, $A_3$ and $A_4$ between the index position 63 and the reflected light 61 from each reflector 54–57, respectively.

Instead of being positioned as described above, if the first reflector 54 were located on the front top edge of the cab 14, the reflector 54 would be in position to always reflect light beam 60. In this way, the other first reflector 55 could be eliminated. However, it has been found that positioning the first reflector 54 on the cab at this location results in relatively small differences between the various angles $A_1$ being detected as the arm 16 is articulated. Such small angular differences reduce the accuracy of the computer calculations using the angles $A_1$. By positioning the first reflector 54 as shown in FIGS. 1 and 2, the differences between the various angles $A_1$ being detected become larger, thereby improving the accuracy of the computer calculations (i.e., optimizing the strength of the figures). Thus, using two first reflectors 54 and 55 for the excavator 10, in the locations shown in FIGS. 1 and 2, can help to ensure that the various angles of the boom 18, relative to the excavator platform 12, are being accurately and unambiguously determined. The second and third reflectors 56 and 57 are similarly located to maximize the difference between the various angles $A_3$ and $A_4$, respectively.

With the above described placement of apparatus 50 (see FIGS. 1 and 2), the reflectors 54–57 will be illuminated in the same sequence during each rotation of laser beam 60. With this placement on machine 10, the transceiver 52 is located within each circle described, at least in part, by the movement of reflectors 56 and 57 as they rotate about pivot points 22 and 24, respectively. When the transceiver 52 is so positioned, the angle of each arm segment 18 and 20, relative to the platform 12, can be uniquely defined by a single angle measurement computed from the output signals of the transceiver 52. For the machines 10 where the arm 16 only moves in short arcs, such as that found with some front-end loader type earthmoving machines, the transceiver 52 can be mounted on the cab 14 or elsewhere on the platform 12. In this way, the circles described by the movement of the reflectors 56 and 57 on such machines are large enough to encompass the transceiver 52, even though the transceiver 52 is not mounted on the arm 16.

The apparatus 50 can be used with an automatic or manually operated machine 10. It is envisioned that the transceiver 52 will be powered off of a portion of the existing electrical system of the machine 10. For example, the transceiver 52 can be electrically connected to the machine's lights. The lights on a typical excavator 10 are often mounted on the front of the cab 14 near the arm 16.

To aid an operator in controlling the position of the bucket 26, it is desirable for the apparatus 50 to include some kind of a display for graphically, pictorially or otherwise visually indicating the position of the tip of the bucket teeth 30 relative to a grade elevation, in response to the position computations performed by the computer 62. A basic graphical user interface (GUI) software program can be used in displaying the orientation of the arm 16, according to conventional software techniques. Such GUI programs are well known and, therefore, not described in detail herein. The GUI software can be run externally on a separate laptop or on any other suitable computer. It is desirable for the GUI program to be the type that runs under MS Windows and which displays a schematic drawing of the arm 16 on a display window. It is also desirable for the Y-axis and X-axis position (i.e., the elevation and extension) of the tip of the bucket teeth 30 to be displayed in the upper right corner of the display window. It is further desirable for a horizontal line, indicating the ground surface level, and a second thicker line, representing the desired digging depth, to also be displayed. The position of the bucket teeth 30 is continuously updated each revolution of the laser beam 60, during the operation of machine 10.

The Laser Transceiver

Figure 4:
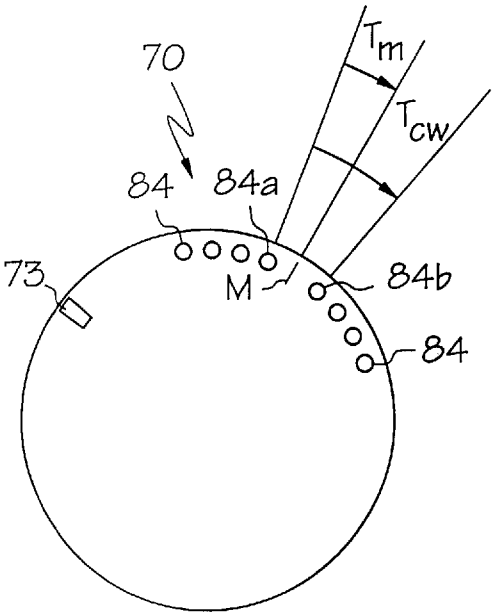
FIG. 4 is an enlarged partial top view of a rotating member illustrated in FIG. 3.
Figure 3:
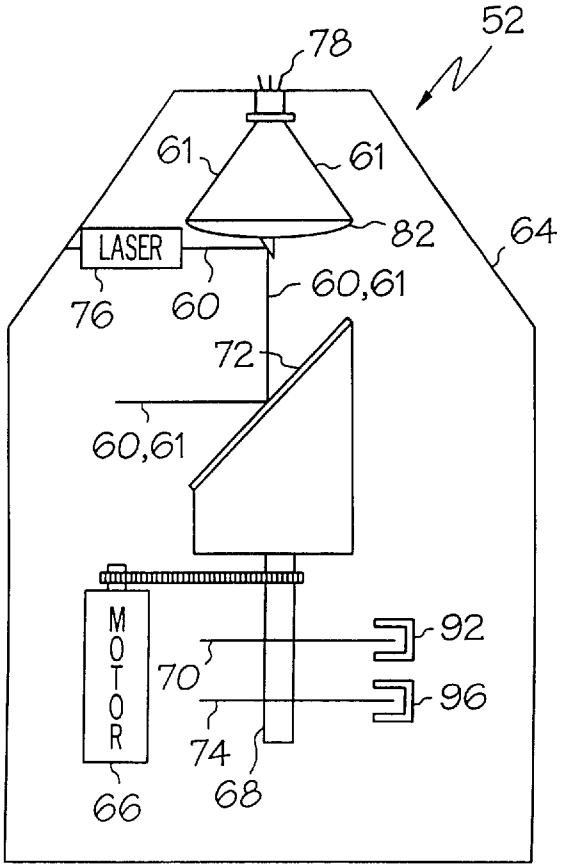
FIG. 3 is a side diagrammatic view, with parts broken away, revealing the internal workings of a laser light transmitting and detecting mechanism used in one embodiment of a tool position determining apparatus of the present invention.

Any suitable laser transmitting and detecting mechanism can be used for the laser transceiver 52, such as that manufactured by Spectra-Physics Laserplane, Inc., the assignee of the present application, Model No. 2190, under the trademark CAPSY™ (Computer Aided Positioning System). Referring to FIGS. 3 and 4, a housing 64 is used to contain one example of such a transceiver 52. This transceiver 52 includes an electric motor 66 mounted to rotate a shaft 68. A member 70, such as a code wheel, and a light diverting mirror 72 are mounted on the shaft 68. As described more fully below, a member pick up element 92 detects the rotation of the member 70 and the passage of an index element 73 mounted on member 70. Member pick up element 92 also produces a single reference pulse each time index element 73 is detected. This reference pulse is indicative of the index position 63 (see FIG. 1). As described more fully below, the index position 63 serves as the starting point from which all angle measurements of the reflectors 54–57 are made. As one skilled in the art will appreciate, index element 73 may be of any configuration which produces a reference pulse that is distinguishable from signals produced by pickup elements 84 (see discussion below). Alternatively, an index pickup element 96 can be used with an index wheel 74, separately mounted to shaft 68, for providing the single reference pulse.

A solid state laser 76, or other suitable light source, directs the beam of light 60 onto the rotating mirror 72 so that a plane of rotating light is created. The orientation of this plane of light (i.e., vertical, tilted or horizontal) depends on the orientation of the housing 64 on the machine 10. An advantage of this type of transceiver 52 is that a precisely oriented plane is not essential for the angle calculations. As a result, the present invention can be used on arms which move up and down in a vertical plane, side to side in a horizontal plane or at any angle therebetween.

When the rotating laser beam 60 strikes the reflectors 54–57 during each revolution of the shaft 68, the resulting reflected light 61 travels back to the transceiver 52 and is directed by the mirror 72, along substantially the same path as that originally followed by beam 60, to a suitable detector, such as a photo detector 78. The photo detector 78 transforms the reflected light 61 into an analog signal. This analog signal is then transmitted to a signal processor 80 (see FIG. 5), which outputs two digital signals, for reasons discussed below. It may be desirable for the rotating mirror 72 to divert the reflected light beam 61 through a collimating lens 82, or other suitable structure, for focusing the reflected light 61 toward the photo detector 78.

The time it takes for one complete rotation of beam 60 is directly related to a total angle of 360 degrees. The angles $A_1$, $A_2$, $A_3$ and $A_4$ between the reflectors 54–57 and the index position 63 can thus, theoretically, be determined by adding about half of the time that each reflector 54–57 remains illuminated by beam 60 (i.e., the time that reflected light 61 from each reflector 54–57 is being detected) with the time between the detection of the index position 63 (whether indicated by the reference pulse provided by the index element 73 or wheel 74) and the moment in time that the reflection of beam 60 by each reflector 54–57 begins, respectively. The orientation of the arm 16, and thus the location of the bucket 26 and its teeth 30, can then be calculated from these angles $A_1$, $A_2$, $A_3$ and $A_4$ once the geometric relationship between the transceiver 52, the reflectors 54–57 and the machine 10 is known.

However, this time/angle relationship is only accurate if the rotational speed of the beam 60 is extremely constant. Typically, the rotational speed of motor shaft 68, which causes the beam 60 to rotate is not perfectly constant. As a practical matter, it is not possible to rotate shaft 68 at a constant speed with the accuracy which is desired by the tool positioning apparatus of the present invention, especially in mobile operations. Consequently, the motor 66 is utilized in conjunction with the member 70, supported by the dedicated hardware interface shown in FIG. 5 and controlled by software, to achieve the desired accuracy. The computer 62, therefore, contains software for a main routine which controls the hardware interface of the apparatus 50. An exemplary listing of this software is included following the detailed description.

As shown in FIG. 4, the member or code wheel 70 has a plurality of angularly positioned elements, such as in the form of apertures 84 spaced around its periphery. The index element 73, as previously described, provides an indication of the index position 63. The apertures 84 divide a revolution of the wheel 70 into a plurality of generally equal partial revolutions. For example, the code wheel 70 may divide a revolution into one thousand generally equal parts positioned approximately 0.36 degrees apart by spacing one thousand elements or apertures 84 around the periphery of the member 70. The size and spacing of these apertures 84 are greatly exaggerated in the drawing for clarity of illustration. Although the distance between each adjacent pair of apertures 85 theoretically represents a movement of 0.36 degrees, misalignment of the member 70, misalignment of the center member 70 through which the shaft 68 extends and manufacturing tolerances can cause deviations in the spacing of the elements 84. Since these deviations remain constant once the transceiver is assembled, the actual angular spacing between each element 84 in member 70 can be determined extremely precisely. Thus, calibration of the code wheel or member 70 can improve its accuracy by eliminating errors due to misalignments, deviations and irregularities of the rotational speed of the motor 66.

Accordingly, even though the spacings between apertures 84 are not exactly equal, it is possible to make accurate angular measurements using this transceiver 52 by storing these actual angular spacings in the computer 62 as a software calibration table. The calibration table used is unique to each transceiver 52. Any speed fluctuation of the motor 66 between two adjacent apertures 84 will be negligible, particularly when there are one thousand such apertures 84 spaced around the periphery of the member 70. Consequently, it is possible to interpolate between an adjacent pair of apertures, such as 84*a* and 84*b* in FIG. 4, to determine an exact angle of a point M in time between the pair of apertures 84*a* and 84*b*, according to the equation:

$$\text{Angle}=\angle 84a+(Tm/Tcw)*(\angle 84b-\angle 84a)$$

where ∠84*a* is the measured angle between the index position 63 and the aperture 84*a*; ∠84*b* is the measured angle between the index position 63 and the aperture 84*b*; Tm is the time elapsed between passage of the previous aperture, here aperture 84*a*, and the moment M in time that the reflected light 61 strikes the sensor or photodetector 78; and Tcw is the time it takes the code wheel 70 to move between element 84*a* and element 84*b*. One method that can be used to calibrate the code wheel or member 70 is disclosed in the previously incorporated U.S. Pat. No. 5,076,690.

Figure 5:
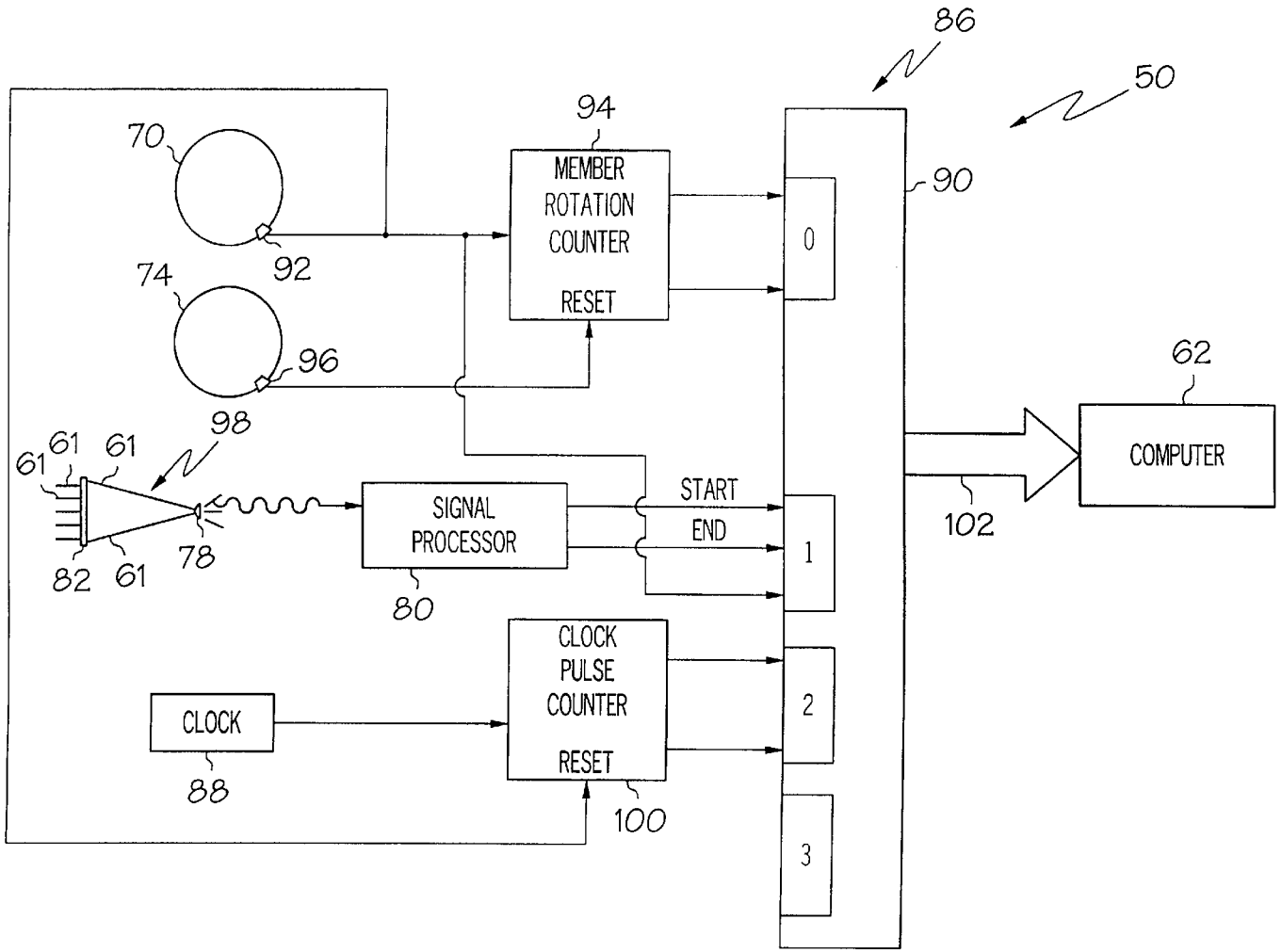
FIG. 5 is a schematic block diagram of a hardware interface, controlled by software, which supports one embodiment of the tool position determining apparatus of the present invention.

Referring to FIG. 5, the use of the code wheel 70 and the motor 66 by the transceiver 52 is supported by a hardware interface 86. An event occurs every time an aperture 84 on the code wheel 70 passes or one of the reflectors 54–57 commences or ends a reflection of the beam of light 60. Due to the high precision time measurements required between each adjacent pair of apertures 84, a reference clock 88 is used in keeping a record of an event. If an event occurred during this time, it is stored in a circuit 90, such as a 32 bit first-in-first-out circuit. The circuit 90 records the movement of the code wheel 70 at register zero. The actual element or aperture 84 which is currently passing is sensed at the member or code wheel pickup element 92 and counted by a member rotation counter 94. Each time the member 70 has complete a full rotation, the member pick up element 92, in response to the index element 73, sends an index position signal to reset the member rotation counter 94. If the index wheel 74 is used, the index pickup element 96 sends the index position signal to reset the counter 94. The member pickup element 92 is operatively adapted for detecting movement of each of the elements 84 past a predetermined point as the member 70 rotates. It is desirable for the pickup element 92, and if applicable pickup element 96, to comprise a light source paired with a photodetector element.

The signal processor 80 is operatively adapted to detect when receiving optics 98, here consisting of collimating lens 82 and photodetector 78, is either commencing or ending receipt of the reflected light 61 from the reflectors 54–57. The signal processor 80 can transform the analog signal from photodetector 78 into two digital signals which are received at register 1 of circuit 90. The first digital signal represents a START signal which indicates that the reflection of beam 60 from one of the reflectors 54–57 to the transceiver 52 is commencing, and the second digital signal is an END signal which indicates that the reflection is ending. Alternatively, the signal processor 80 is operatively adapted to digitize the analog signal from the photodetector 78. The digital signal is then analyzed to determine when a reflection of the beam 60 from one of the reflectors 54–57 is starting and when the reflection is ending. Such analysis may include indicating successive START and END signals as the digital signal exceeds and falls below a certain value.

Further referring again to FIG. 5, register 2 receives signals for measuring the time elapsing between the passage of the last aperture 84 and an event, which event may be the time Tm or the time Tcw shown in FIG. 4. A clock pulse counter 100 is reset at every passage of an aperture 84 as detected by the element 92 and, consequently, the counter 100 counts the time elapsing between the passage of each pair of adjacent elements 84. Information regarding the capacity of circuit 90 is stored in register 3.

The circuit 90 stores the information received and provides an output signal 102 to the computer 62, which includes a microprocessor having a memory. The computer 62 is responsive to the output signal 102 and computes the coordinates of the reflectors 54–57 relative to the machine 10. After determining the position of at least reflectors 54, 56 and 57, the computer 62 can compute the orientation of the bucket 26 and the position of the teeth 30 relative to the platform 12 of machine 10 because the geometric relationship between the reflectors and the machine is in the computer memory.

As discussed above, it is desirable to use anonymous reflectors of simple construction rather than self-identifying reflectors. However, if the reflectors 54–57 are made self-identifying, such as by incorporating unique bar code patterns into their reflective surfaces, each reflector may have a unique series of START and END signals resulting from the transceiver 52 detecting reflective light from each bar in the code as the laser beam 60 sweeps past the reflector.

Elevation Measuring System

It is desirable for an elevation measuring system to be used with the bucket position determining apparatus 50 in order to determine the location of the bucket 26 relative to a spacial reference point, such as a reference grade elevation 104. For example, by measuring or otherwise knowing the elevation of the platform 12 of machine 10 relative to the reference grade elevation 104, the software of the computer 62 can be adapted to compute the position of the bucket 26 relative to the grade elevation 104. When the machine 10 is being operated with its platform 12 remaining at the same distance above the grade elevation 104, the position of the bucket 26 relative to this grade elevation 104 can be determined by simply measuring this distance and storing it in the computer 62. The computer 62 can be programmed to then utilize this measured distance in computing the position of the bucket 26 relative to the grade elevation 104.

Many of the machines which can use the present invention do not stay a fixed distance from a given reference point when operated. For an earthmoving machine 10 that moves around a job site or otherwise does not remain the same distance above the reference grade elevation 104, other ways of obtaining this elevation measurement are necessary. Another way this elevation measurement can be obtained is by using a global positioning system (GPS) 103. The GPS 103 is operatively adapted for making at least determinations about the elevation of machine 10 by providing the computer with a signal indicative of the position of a point on the machine 10 relative to the grade elevation. It may be desirable to use a GPS 103 capable of making three-dimensional position location determinations, with centimeter accuracy. One such global positioning system is disclosed in U.S. Pat. No. 5,177,489, which is incorporated herein by reference in its entirety. With such a global positioning system, the location of the machine 10 can be determined anywhere on the surface of the job site. By knowing the location of the machine 10, the location of the bucket 26 on the surface of the job site can be determined by using the apparatus 50 as described above.

A typical global positioning system 103 includes a plurality of time-synchronized satellites broadcasting signals indicating their orbital position above the earth. As shown in FIG. 1, a reference receiver 106 is positioned remotely from the machine 10 at a known elevation relative to the reference grade elevation 104. The receiver 106 has a first antenna 108 for receiving signals from the satellites. A secondary receiver 110 is mounted at a known location on the machine 10 and has a second antenna 112 for also receiving signals from the satellites. The second antenna 112 is in communication with and is free to move with respect to the first antenna 108. At least one GPS computer is associated with at least one of the receivers 106 and 110, is programmed to collect and analyze signals received by each antenna 108 and 112, and calculates at least the difference in elevation between the two antennas 108 and 112. The computer 62 can be programmed to utilize this calculated elevation difference in computing the position of the bucket 26 relative to the grade elevation 104. It may also be desirable for the GPS computer to calculate the location of the two antennas 108 and 112 in three dimensions, relative to one another. The GPS computer can be separate from or form a part of the computer 62 and can be remote from or mounted on the machine 10.

Figure 6:
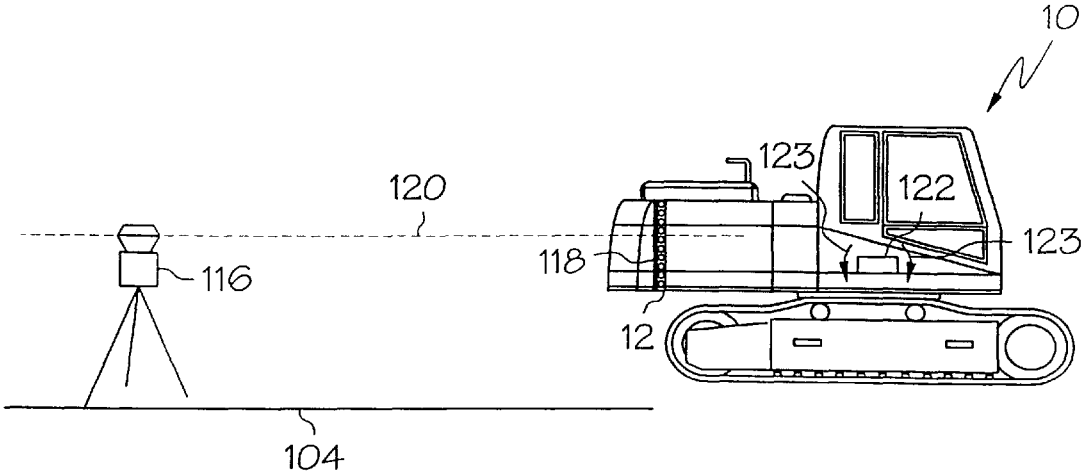
FIG. 6 is a side view of one embodiment of a reference measuring system according to the principles of the present invention using a level reference laser system.

Referring to FIG. 6, as an alternative, the elevation measuring system can also be a level reference laser system 114, such as that disclosed in U.S. Pat. No. 5,375,663, which is incorporated herein by reference in its entirety. A typical level reference laser system 114 includes a laser transmitter 116 mounted remotely from the machine 10 for transmitting a beam of laser light and a laser receiver 118 mounted at a known location on the platform 12 of the machine 10 for detecting the laser beam. The transmitter 116 rotates the beam of laser light to form a reference plane of laser light 120 a known distance above the reference grade 104. It is desirable for the transmitter 116 to be operatively adapted so that the laser reference plane 120 remains substantially parallel to the reference grade 104. The receiver 118 has a plurality of sensors disposed along its length in a known relationship to the platform 12, with at least one sensor crossing and being illuminated by the laser reference plane 120 at all times during the operation of the machine 10. Each sensor detects when it is illuminated and sends a corresponding signal to a computer, such as computer 62, indicating the distance between the reference plane 120 and the platform 12. The computer 62 can be programmed to utilize this signal in computing the position of the bucket 26 relative to the grade elevation 104, by knowing the relationship between the reference plane 120 and the reference grade 104.

It is also desirable for the level reference laser system 114 to include a dual axis x-y sensor 122 mounted on the platform 12 of machine 10. The sensor 122 provides the computer 62 with signals corresponding to the pitch of the platform 12 (indicated by the arrows 123). The computer 62 can be programmed to utilize the detected distance between the reference plane 120 and the platform 12, indicated by signals from the sensors of receiver 118, with the signals from the sensor 122 to determine the angle or slant of the platform 12 relative to the reference plane 120 of laser light, and thereby relative to the reference grade 104.

Installation Setup Procedure

When the apparatus 50 is installed on an excavator 10, a number of parameters must be determined and provided to the computer 62 in order for the apparatus 50 to function properly. These parameters fall under two basic groups, excavator specific parameters and installation specific parameters. Excavator specific parameters include specific dimensions of the excavator 10, in particular the dimensions of the arm 16. The specific parameters that are relevant to the type of excavator 10 shown in FIG. 1 include the effective lengths of the boom 18 and of the stick 20, and the dimensions of the bucket mechanism elements 39 and 41.

The installation specific parameters describe how the apparatus 50 is mounted on the excavator 10 and typically vary for each installation of the apparatus 50, even for the same type of excavator 10. The installation specific parameters include the relative distances and locations of the various components of the apparatus 50 such as, for example, the location of the transceiver 52 on the boom 18, the location of the first reflectors 54 and 55 on the excavator cab 14, the location of the second reflector 56 on the stick 20 and the location of the third reflector 57 on the bucket mechanism 37.

It is understood that the above described specific parameters may be different for different types of apparatus 50 and machines 10. The above installation specific parameters can either be measured or otherwise obtained during the installation of the apparatus 50. The excavator specific parameters can either be measured directly or obtained from the equipment specifications from the manufacturer of the excavator 10. Making actual measurements of the excavator 10 can be difficult and time consuming, and sometimes almost impossible. Such dimensions can be easily and quickly obtained from the excavator's technical specifications, but these may prove inaccurate due to significant differences between the actual dimensions of the excavator 10 and its designed dimensions. In addition, the dimensions of the excavator 10 will likely change with time as a result of the normal wear and tear typically experienced by earthmoving equipment.

A setup procedure, for use during the installation of the apparatus 50 on a typical hydraulic earthmoving excavator 10 has been developed to determine many of the dimensional relationships (i.e., parameters), without having to make actual measurements. In particular, this setup procedure can be used to at least determine the installation specific parameters. In addition to being used when the apparatus 50 is initially installed, this setup procedure can also be used to subsequently verify or confirm these parameters, as part of a periodic maintenance procedure.

Figure 7:
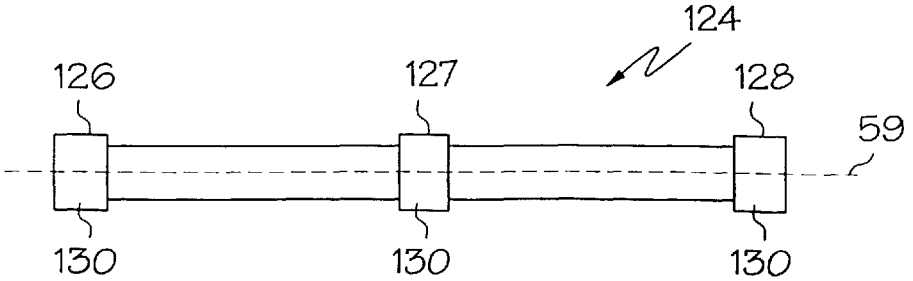
FIG. 7 is a plan view of a reference ruler used in calibrating a tool position determining apparatus according to the present invention.

Referring to FIG. 7, one embodiment of the above setup procedure includes using a set of three light reflectors with known relative locations to calculate the unknown locations of the reflective targets 54–57. For example, a reference ruler 124 can be used which includes three reflectors 126, 127 and 128. In addition, this setup procedure uses numerical calculation techniques similar to those that can be used in operating the transceiver 52, as is explained in the previously incorporated U.S. Pat. No. 5,076,690.

Each reflector 126–128 is retroreflective so as to reflect laser light back toward a light source. The reflectors 126–128 can be self-identifying, such as with unique bar code patterns on their reflective surfaces 130. The reflectors 126–128 can also be the anonymous type of a simple reflective construction. The distance between each of the reflectors 126–128 is fixed and known. Satisfactory results have been obtained by using a 3400 mm long reference ruler having the middle reflector 127 mounted 1600 mm from one end of the ruler 124 and 1800 mm from the other end of the ruler 124. Satisfactory results should also be obtained when the center reflector 127 is mounted exactly in the middle of the ruler 124.

One exemplary setup procedure includes a boom motion step, a stick motion step and a bucket motion step. In the boom motion step, it is desirable for the excavator 10 to be parked on a flat surface. This flat surface need not be horizontal. The ruler 124 is then positioned on the ground in front of the excavator 10, beneath the arm 16, so that the reflectors 126–128 of the ruler 124 are aligned with the plane 59 of laser light 60 emitted by the laser transceiver 52. That is, the reflectors 126–128 are in position to reflect the laser beam 60 back to the transceiver 52. Because the laser plane 59 can be difficult to locate, a LaserEye® receiver (not shown), such as that manufactured by Spectra-Physics Laserplane, Inc., the assignee of the present application, Model No. 1175, can be used to locate the laser plane 59 for alignment with the reflectors 126–128.

Once the ruler 124 is so aligned, the excavator boom 18 is rotated about its pivot point 22 from its lowest possible configuration (i.e., the fully extended view of arm 16 on the bottom of FIG. 1), through a number of intermediate positions and to the highest configuration where all of the reflectors 54–57 remain visible to the transceiver 52. For an exemplary excavator 10, satisfactory results can be obtained by rotating the boom 18 approximately 40° in about 20 small increments (i.e., to about 20 small intermediate positions) of approximately 2° each. At each position of the boom 18, the angle measuring capability of the transceiver 52 is used to make a set of two or more angle measurements of the reflectors 126–128 relative to the index position 63. Each set of angles is stored and used to average out small disturbances and instabilities of the reflector position sensing system of the transceiver 52 that may affect the angle measurements of the ruler reflectors 126–128 at each boom position. For each incremental rotation of the boom 18, it may be necessary to wait 10–20 seconds or so in order to allow vibrations of the excavator arm 16 to dampen out before angular measurements of the ruler reflectors 126–128 are taken. It may also be necessary to wait for vibrations to dampen out after moving the stick 20, as described below. The stick 20 and the bucket 26 are kept relatively stationary throughout the rotations of boom 18.

A number of the installation specific parameters can be calculated using the data provided by the above described boom motion step and the exemplary software program, for performing the setup procedure, included herein. These calculated parameters include: (1) the location of the boom pivot point 22 relative to the reference ruler 124 (i.e., the surface of the ground 104 on which the ruler 124 lies) and, therefore, the elevation of the pivot point 22 relative to the ground surface level 104; (2) the radius of the arc or curve defined by the various positions of the transceiver 52 as the boom 18 is rotated (i.e., the distance between the boom pivot point 22 and the transceiver 52); (3) the location of either first reflector 54 and 55 relative to the boom pivot point 22 and the reference ruler 124 on the ground 104; and (4) the value of the constant reference angle between the transceiver index position 63 and the boom pivot point 22.

By knowing the distances between the reflectors 126–128 on the ruler 124 and by measuring the angle between each reflector 126–128, with the angle measuring capabilities of transceiver 52, the distance between the reflectors 126–128 and the transceiver 52 can be determined using the position determining capabilities of the transceiver 52 (i.e., the position computing capabilities of the computer 62). The locations of the transceiver 52 relative to the ruler 124, as the boom 18 is incrementally rotated about point 22, form a curve. The distance between the transceiver 52 and the boom pivot point 22 can be easily and accurately determined, without having to actually measure the distance, by plotting this curve and using simple geometric principles to locate the point of rotation 22. By eliminating the potential human error associated with making such a measurement, highly accurate determinations of the distance between the transceiver 52 and the pivot point 22 can be consistently made, regardless of how often the transceiver 52 is repositioned on the boom 18. Being able to calculate this distance is advantageous because, for some machines 10, it may not even be possible, as a practical matter, to measure the distance between the transceiver 52 and the pivot point 22.

In the stick motion step of the exemplary installation setup procedure disclosed herein, it is desirable for the reference ruler 124 to be mounted to the stick 20, for example, on the second and third reflectors 56 and 57, rather than being positioned on the ground. The ruler 124 is oriented lengthwise along the length of the stick 20, with its reflectors 126–128 in line with the laser plane 59. The exact location of the ruler 124 on the stick 20 is not necessarily critical because the angle measurements of its reflectors 126–128 and of the targets 45, 56 and 57 can provide the information needed to determine the relationship between the ruler 124 and the reflective targets 56 and 57. The angle measurements from the temporary reference reflector at point 45 may not be necessary to determining this relationship. By knowing the dimensions of the ruler 124 (i.e., the distances between the reflectors 126–128 on the ruler 124) and by measuring the angle between each reflector 126–128, as described above, the trajectory or path followed by the ruler 124 can be calculated. Knowing the trajectory followed by the ruler 124 and the angular relationship between all of the reflectors 126–128, 45, 56 and 57 enables the relationship between the ruler 124 and the targets 56 and 57 to be determined.

It is desirable for the ruler 124 to be mounted behind the reflective targets 56 and 57 such that the targets 56 and 57 and the ruler reflectors 126–128 are able to reflect the laser light 60 from the transceiver 52. A temporary reference reflector (not shown), similar to the reflective targets 56 and 57, can be mounted at pivot point 45, for example, by being threaded into an existing threaded hole at point 45. The boom 18 is fixed at an arbitrary configuration which allows the stick 20 to rotate through its full range without the bucket 26 hitting the ground 104. The bucket 26 is kept relatively stationary throughout the rotation of the stick 20. With the boom 18 and the bucket 26 kept stationary, the stick 20 is rotated about its pivot point 24, through its full range of motion. As with the boom motion step, the stick 20 is rotated incrementally to approximately 20 positions within its full range of motion, with a set of two or more angle measurements being made at each position of the stick 20.

A number of installation specific parameters can be calculated using the data provided by the above described stick motion step and the exemplary software program, for performing the setup procedure, included herein. These calculated parameters include: (1) the distance between the transceiver 52 and the stick pivot point 24; (2) the distance between the pivot point 24 and the second reflector 56; (3) the angle 56-24-45 defined by two lines diverging from the pivot point 24, one extending to the reflector 56 and the other to the pivot point 45; (4) the location of the reflector 56 relative to the pivot points 24 and 45, which is determined by using the distance and angle of parameters (2) and (3), above; (5) the value of the constant reference angle between the transceiver index position 63 and the stick pivot point 24; and (6) the distance between the pivot point 45 and the third reflector 57, using the temporary reference reflector mounted at the pivot point 45.

The location of the transceiver 52 on the boom 18 can be calculated using the distance between the pivot points 22 and 24, the distance between the transceiver 52 and the point 22, and the distance between the transceiver 52 and the point 24. The distance between the points 22 and 24 can be obtained by making measurements or from the excavator's technical specification. The distances between the transceiver 52 and the two pivot points 22 and 24 can be obtained as described above.

By knowing the distances between the reflectors 126–128 on the ruler 124, the spacial orientation of the ruler 124 (i.e., of the stick 20) can be determined, in addition to the distance between the ruler 124 and the transceiver 52. By using the angle measuring capabilities of the transceiver 52, the angle between the index position 63 and any unknown reflector on the stick 20 (i.e., targets 56 and 57, and the reference reflector temporarily mounted at the pivot point 45) can be measured and recorded in the computer 62. These angles are measured multiple times for each position of the stick 20 and averaged. Each time the stick 20 is moved, the new position of the ruler 124 is calculated, by again averaging multiple angle measurements for each of its three reflectors 126–128 and for each of the reflectors 45, 56 and 57 on the stick 20.

For each position of the stick 20, the data on the orientation of the ruler 124 and the angle corresponding to one of the stick reflectors 45, 56 or 57 is enough to set up an equation with one unknown, i.e., the distance between the transceiver 52 and the stick reflector 45, 56 or 57 in question. A number of angle measurements are taken at each position of the stick 20 to provide enough data to ensure an accurate solution of the equation and, thereby, obtain the distance from the transceiver 52 and the applicable stick reflector 45, 56 or 57. These angles are measured for a number of different ruler positions (i.e., stick positions) in order to obtain enough data to solve all of the equations and thereby calculate the desired geometric relationships between the stick reflectors 45, 56 and 57 and the ruler reflectors 126–128.

In the bucket motion step, the distance from the center of the third reflector 57 and the bucket mechanism pivot point 49 is measured. This third step in the exemplary setup procedure enables the parameters to be determined which describe the bucket mechanism 37. The only installation dependent parameter that has to be determined is the angle 49-45-57 defined by two diverging lines from the pivot point 45, one extending to the pivot point 49 and the other to the target 57. The most convenient method of determining the dimensions of the bucket mechanism 37 is to use the technical specifications of the excavator 10. However, it may be more accurate to measure the necessary dimensions. Accordingly, the angle 49-45-57 is determined by measuring the length (i.e., distance) of each side of the triangle defined by the pivot points 45 and 49 and the target 57. The accuracy of the overall system is only marginally affected by the accuracy of these measurements. Small errors in the dimensions of the bucket mechanism 37 typically will not cause large deviations in the calculation of the position of the tip of the bucket teeth 30. Because the bucket 26 is at the end of the arm 16, there is no propagation of errors in other calculations.

Even under normal use, there can be a considerable amount of clearance or movement in the joints of an earthmoving excavator arm 16, as the arm 16 is articulated. The additional movement in the joints allowed by such clearances can reduce the accuracy of the apparatus 50. It has been found desirable to calculate unknown installation specific parameters using the least square method. The use of the least square method helps to eliminate the risk of incorrect setup results, because bad setup results can easily be detected and rejected by using this method. The effect on the setup results of local inconsistencies in the various angles and distances measured or calculated, for example due to joint clearances, is limited because such inconsistencies are averaged out over the range of motion of the boom 18 and the stick 20. Such inconsistencies in the bucket mechanism 37 have an even smaller effect because the effective length of the bucket 26 (i.e., the distance from the pivot point 28 to the tip of the bucket teeth 30) is relatively small compared to the total size of the excavator arm 16. A listing of an exemplary software program for performing the above described setup procedure is included following this detailed description.

The above-described setup procedure is effective, uncomplicated and has been performed in as little as half of an hour. This exemplary setup procedure can be performed by one person and the use of special equipment and tools can be kept to a minimum. Three accessories are used during the procedure; a reference ruler with three targets attached to it, a reference reflector that can be mounted at the pivot point 45, and some form of distance measuring device, such as vernier calipers or a tape measure. The general principles described above in this exemplary setup procedure may be applicable to setting up various types of machines suitable for being used with the present apparatus. Accordingly, these principles are not intended to be limited to being used with excavators or other types of earthmoving equipment.

The present invention for determining the position of a bucket, or other tool, mounted on the end of an arm exhibits a number of advantages. For instance, the present invention can use position measuring components (e.g., the light reflective targets 54–57) of relatively simple and rugged, or at least easily replaceable, construction. These components can be mounted at those locations on the arm which are exposed to the greatest risk of being damaged, very often arm's leading end. In this way, the present invention is better able to withstand the adverse working conditions often encountered in many applications, such as excavating earth at a construction site.

The present invention is also capable of determining the position of the tool with a high degree of accuracy, at least in part, because it can employ laser technology in its position measuring. Accuracies of up to approximately ±1 cm in grade or elevation (i.e., in the Y-axis) and ±2 cm in extension (i.e., in the X-axis) have been obtained. With time, the degree of accuracy obtained may be affected by a number of effects, such as wear of the bucket teeth 30, slack in the joints of the arm 16, normal wear and tear of the transceiver 52 or the reflectors 54–57 (e.g., a reflector being bent). However, the above described installation setup procedure can be used to recalibrate the apparatus 50 whenever the accuracy of the present invention comes into question or as part of a routine maintenance procedure. The present invention is simple to install, even on construction equipment, such as conventional earthmoving machines, and simple to setup, even at an outdoor job-site. Furthermore, the present invention can be used with a variety of machines which have a tool mounted on a pivotable arm, including different types of construction equipment and robotic arms. The present invention can be used with such a pivotable arm regardless of the orientation of the plane in which the arm moves.

The following is an exemplary software program, to be stored in the computer 62, (1) for controlling the hardware interface 86 and (2) for using a calibration table of the transceiver's reflector position sensing system:

-37-

```
*****************************************************************************
*
*     Multi Level Scanning Algorithm.
*     Leon DeVos. Spectra Physics Laserplane. 3/26/93
*                 Adapted for excavator       6/12/95
*
*
*
NR_CROSS SET      10
LAST     SET      40
NR       SET      42
*
      SECTION Mlsasm,,"code"
*
      XDEF  _XAna1
      XREF  _Cw,_Pulse,_StartPulse,_pr_rings
*
*     XAna1( word *raw_buf, word    raw_size, MAX_NCW );
*
STK0     SET     2*4
*
_XAna1:
      movem.l  a1/d2,-(sp)        * save register.
      move.l   4+STK0(sp),a0      * start of buffer.
      move.l   8+STK0(sp),d0      * length of buffer.
      ble      xa1_ext            * that's it.
      move.l   12+STK0(sp),d2     * length of Cw.
      move.l   _Cw,a1             * setup for ini.
      subq.l   #1,d0              * dbf instr.
*
xa1_10:  tst.w (a0)+              * zero ?
      bne      xa1_90             * no, so skip.
      move.w   2(a0),d1           * cw-word.
      and.w    #$0fff,d1          * mask off cw nr.
      move.w    d1,(a1)           * c->cw = d1.
      move.w   (a0),2(a1)         * c->time = buffer.
      and.w    #$0fff,2(a1)       * get rid of lvl.
      addq.l   #4,a0              * synchronize buffer pointer.
      addq.l   #4,a1              * synchronize structure pointer.
      subq.l   #2,d0              * and the loop counter too.
      subq.l   #1,d2              * test on end of Cw-array.
      beq      xa1_ext
xa1_90:  dbf      d0,xa1_10       * keep on looping.
xa1_ext:
      move.l   a1,d0              * end of Cw.
      sub.l    _Cw,d0             * subtract start of array.
      lsr.l    #2,d0              * #structures.
      movem.l  (sp)+,a1/d2        * restore register.
      rts
*
      XDEF  _XAna2
      XREF  _match_ring,_Hlvl,_Llvl
      XREF  _Debug1,_Debug2,_Debug3,_Debug10,_Debug11
      XREF  _Cangle,_Cdif,_T1,_T2,_Cwnr
      XREF  _Ring,_Pcross,_Cross
*
*     XAna2( word *raw_buf, word *raw_size );
*
STK3     SET     8*4
*
_XAna2:
      movem.l  d2-d3/a1-a6,-(sp)  * save register.
      move.l   4+STK3(sp),a3      * start of buffer.
      move.l   8+STK3(sp),d3      * length of buffer.
      ble      xa2_ext            * that's it.
      move.l   _Cw,a5             * ini for cw-structure.
      move.l   _StartPulse,_Pulse
      move.l   _Pulse,a6          * ini for Pulse-data.
      move.w   (a5),_Cwnr         * first #cw.
      move.w   2(a5),_T2          * first cw time.
      subq.l   #1,d3              * dbf instr.
*
xa2_10:  tst.w (a3)               * zero ?
```

SPC 227 PA -38-

```
      bne       xa2_70              * no, so skip.
      addq.l    #4,a5               * next structure.
      move.w    (a5),_Cwnr          * next #cw.
      move.w    2(a5),_T2           * next cw time.
      addq.l    #6,a3               * synchronize.
      subq.l    #2,d3               * the counter too.
      bra       xa2_nxt             * next loop.
xa2_70:
      clr.l     d0                  * clear register.
      move.w    (a3)+,d0            * get next sample.
      move.b    -2(a3),d0           * pick up next sample.
      lsr.b     #4,d0               * only upper nibble( then  4).
*                New Xing.
      move.b    _Cross,_Pcross      * fix previous.
      move.b     d0,_Cross          * new Cross.
*                Cross != Pcross ?
      cmp.b     _Pcross,d0          * new xing?
      beq       xc_ext              * no, exit.
*
      move.w    -2(a3),d0           * time component to lower word.
      and.w     #$0fff,d0             * mask off lvl.
      move.l    _Cdif,a0            * prepare for interpolation.
      move.w    _Cwnr,d1            * #cwnr as index.
      muls.w    (a0,d1.w*2),d0      * d0 <= T1 * Cdif[Cwnr].
      clr.l d2                      * convert to long.
      move.w    _T2,d2              * copy T2 to long.
      beq       xc_ext              * just in case.
      divs.l    d2,d0               * d0 / T2
      move.l    _Cangle,a0          * start of table.
      add.l     -4(a0,d1.w*4),d0    * add actual angle of Cwnr-1.
      move.l    d0,angle            * store for further use.
*
*
      move.l    d0,(a6)+
      move.b    _Cross,-4(a6)
*
*
      clr.l     d2                  * clear complete long.
      move.b    _Pcross,d2          * ini d2.
      move.l    #_Ring,a1           * ini a1.
      move.l    d2,d0               *
      muls.l    #44,d0              * 10 * long + 2 * short.
      add.l     d0,a1               * add to start of Ring.
      cmp.b     _Cross,d2           * Cross > Pcross ?
      bgt       xc50                * Cross < Pcross !
*                Cross > Pcross
xc30:
      jsr       ChkXing
      addq.b    #1,d2               * increment loop.
      add.l     #44,a1              * next row on structure.
      jsr       inrlp1              * do inner loop.
      cmp.b     _Cross,d2           * end of loop
      blt       xc30                * keep going.
      bra       xc_ext              * done.
*                Cross < Pcross, still descending....
xc50:
      subq.b    #1,d2               * decrement loop.
      sub.l     #44,a1              * previous structure.
      jsr       inrlp2              * do inner loop.
      cmp.b     _Cross,d2           * end of loop
      bgt       xc50                * keep going.
*
xc_ext:
xa2_nxt:
      dbf       d3,xa2_10           * keep on looping.
      jsr       ChkXing             * anything left ?
xa2_ext:
      move.l    a6,_Pulse
      movem.l   (sp)+,d2-d3/a1-a6   * restore register.
      rts
*
ChkXing:
      clr.l     d0                  * set up for middleling.
      move.b    _Hlvl,d0            * top.
```

SPC 227 PA -39-

```
        beq       chk10              * branch if zero.
        add.b     _Llvl,d0           * valley.
        lsr.b     #1,d0              * divide by two.
        move.l    d0,-(sp)           * argument to stack.
        jsr       _match_ring        * try to match it.
        addq.l    #4,sp              * adjust stack.
        clr.b     _Hlvl              * reset High level.
chk10:  rts
*
inrlp1:
*       jsr       _Debug3
        clr.l     d1                 * clean it up.
        move.w    NR(a1),d1          * d1 <= r->nr.
        add.w     LAST(a1),d1        * += r->last.
        divsl.l   #NR_CROSS,d0:d1    * d0<= % NR_CROSS.
        move.l    angle,(a1,d0.l*4)  * r->angle = angle.
        move.w    NR(a1),d0          * d0 <= r->last.
        cmp.w     #NR_CROSS,d0       * r->nr == NR_CROSS?
        bne       il_10              * do more if !=.
        move.w    LAST(a1),d1        * d1<= r->last.
        addq.w    #1,d1              * + 1.
        divsl.l   #NR_CROSS,d0:d1    * d0<= % NR_CROSS.
        move.w    d0,LAST(a1)        * remainder to r->last.
        bra       il_20              *
il_10:
        addq.w    #1,NR(a1)          * r->nr++.
il_20:
        jsr       chk_ring
        rts
*
inrlp2:
        clr.l     d1                 * clean it up.
        move.w    NR(a1),d1          * d1 <= r->nr.
        add.w     LAST(a1),d1        * += r->last.
        divsl.l   #NR_CROSS,d0:d1    * d0<= % NR_CROSS.
        move.l    angle,(a1,d0.l*4)  * r->angle = angle.
        move.w    NR(a1),d0          * d0 <= r->last.
        cmp.w     #NR_CROSS,d0       * r->nr == NR_CROSS?
        bne       il_30              * do more if !=.
        move.w    LAST(a1),d1        * d1<= r->last.
        addq.w    #1,d1              * + 1.
        divsl.l   #NR_CROSS,d0:d1    * d0<= % NR_CROSS.
        move.w    d0,LAST(a1)        * remainder to r->last.
        bra       il_40              *
il_30:
        addq.w    #1,NR(a1)          * r->nr++.
il_40:
        jsr       chk_ring
        move.w    NR(a1),d0
        cmp.w     #NR_CROSS,d0       * return value of 'add_ring'.
        bne       il_90              * no, next loop step.
        tst.b     _Hlvl              * is it zero?
        bne       il_45              * no, skip it.
        move.b    d2,_Hlvl           * ini first time.
il_45:
        move.b    d2,_Llvl           * current end of sequence.
        rts
il_90:
        jsr       ChkXing            * anything left ?
        rts
*
*       check on 10.0000 deg span!
chk_ring:
        clr.l     d1                 * prepare for index.
        move.w    LAST(a1),d1        * pick up r->last.
        move.l    (a1,d1.w*4),-(sp)  * store a0.
        add.w     NR(a1),d1          * r->last + r->nr
        subq.w    #1,d1              * - 1.
        divsl.l   #NR_CROSS,d0:d1    * (..) % NR_CROSS.
        move.l    (a1,d0.w*4),d1     * d1 <- a1.
        sub.l     (sp)+,d1           * a1 <- (a1-a0)
        cmp.l     #100000,d1         * a1 - 10000
        blt       cr10               * less, so jump.  (blt)
        subq.w    #1,NR(a1)          * r->NR - 1
```

SPC 227 PA -40-

```
        clr.l     d1                  * prepare for index.
        move.w    LAST(a1),d1         * r->last
        addq.l    #1,d1               * + 1.
        divsl.l   #NR_CROSS,d0:d1     * (..) % NR_CROSS.
        move.w    d0,LAST(a1)         * r->last.
cr10:
*       movem.l   d0/d1/a0,-(sp)
*       jsr       _pr_rings
*        movem.l  (sp)+,d0/d1/a0
        rts
*
*
*       XGetRing( t_ring *r, int nr );
*
        XDEF  _XGetRing
STK2          SET     1*4
_XGetRing:
        move.l    4(sp),a0            * a0 <- r.
        move.l    8(sp),d1            * d1 <- nr.
        add.w LAST(a0),d1             * d1 += r->last.
        divsl.l   #NR_CROSS,d0:d1     * d0 = remainder.
        move.l    (a0,d0.l*4),d0      * angle.
        rts
*
        SECTION data,,"data"
angle:    dc.l    0
```

The following is an exemplary software program, to be stored in the computer 62, (3) for performing reference angle measurements using the transceiver 52, for all of the reflectors 54–57, and using the calibration table of the transceiver's reflector position sensing system:

-42-

```
#include "capsy.h"

#define TOP       1
#define max(a,b) (a>b) ? (a) : (b)

#define MARGIN            20
#define NR_REFL           20
#define NR_LEVELS         16
#define NR_CROSS          10
#define NR_CENTR          (NR_CROSS - 1)
#define NR_SECTORS        10

#define CW_BIT            0x4000

#include    "barpos.h"

typedef unsigned char  byte;
typedef unsigned short word;

typedef struct
{
  long  angle[NR_CROSS];
  short last,nr;
} t_ring;

short   AnaFifo2(long ibuf);
short   XAna1( word *raw_buff, word raw_size, long );
short   XAna2( word *raw_buff, word raw_size);
void    clear_rings (void);
void    update_rings (void);
long    get_ring(t_ring *r, int nr);
word    add_ring(t_ring *r, long ang);
void    match_ring(byte level);
void    init_tables ();
long    Im360( register long a );
void    PrnPls( long lvl, long angle );

int     refl_centr[NR_REFL][NR_CENTR]; /* normalised reflector centers      */
t_ring  Ring[NR_LEVELS];
word    T1, T2, Cwnr;
byte    Pcross, Cross;
byte    Hlvl, Llvl;
long    T_Mask;
short   Ncw, nr_found;

short AnaFifo2( long ibuf )
{
register short i;
register word *raw_buff, raw_size;

   T_Mask    = TgtMsk;
   nr_found  = 1;         /* index for storing in global array A */

   clear_rings ();

   raw_buff  = (word *)Mbuf[ibuf].smem;

   raw_size  = *raw_buff++ / 2;

   XAna1( raw_buff, raw_size, MAX_ICW );

   XAna2( raw_buff, raw_size );

   Npulse = 0;
   Npulse = GetPulses( nr_found );

   clear_rings ();
   RlsBuf( ibuf );

   return nr_found;
}

void
```

SPC 227 PA -43-

```
match_ring ( byte level)
{
int i, j, it;
register    t_ring *r;
register long a0, a1;
long centr[9], diff;
long len, start, mid;
register long *c;
long  iang[10];

  /* calculate centers */

   r   = Ring + level;
   a1  = XGetRing ( r, 0 );
   c   = centr;

   iang[0]  = a1;
   for (i = 1; i <= NR_CENTR; i++) {
      a0  = a1;
      a1  = XGetRing ( r, i );
      iang[i]  = a1;
      *c++ = (a0+a1)/2;
   }

   start = centr[0];
   len   = centr[8] - start;

  /* Added for Pulse recognition */
   Bndry[0][nr_found]    = centr[0] - len/10;
   Bndry[1][nr_found]    = centr[8] + len/10;

   if (len < 1000 || len > 100000)   return;

  /* translate and scale angles */
   for (i = 0; i < NR_CENTR; i++) {
      centr[i] = 1100 * (centr[i] - start) / len + 50;
   }

  /* compare centr with refl_centr[j]                                  */

   mid   = start + len / 2;
   for (j = 0; j <= NR_REFL; j++) {
      if( !(T_Mask&(1<<j)) )  continue;

      for (i = 0; i < NR_CENTR; i++) {
         diff = abs(centr[i] - refl_centr[j][i]);
         if (diff > MARGIN) break;
      }

      if (i == NR_CENTR) {    /* !!!!  found match !!!! */
         A[nr_found].a = Im360(3600000 - mid + Aoffset);
         A[nr_found].itarget = j;
         if( nr_found < MAX_ANGLE )  nr_found++;
         clear_rings ();
         T_Mask &= ~(1<<j);
         return;
      }
   }
}

void init_tables ()
{
int i,j;

   for (i = 0; i < NR_REFL; i++)
      for (j = 0; j < NR_CENTR; j++)
         refl_centr[i][j] = (BarPos[i][j] + BarPos[i][j+1]) * 5;

   clear_rings ();
}

void update_rings (void)
{
register short i, j, nr;
```

SPC 227 PA -44-

```
    if( ScanSw(1) ) {
       printf("Before.\n");
       pr_rings();
       getch();
    }

    for (i = 0; i < NR_LEVELS; i++) {
       if( nr=Ring[i].nr ) {
          for( j=0; j<NR_CROSS; j++ ) Ring[i].angle[j] -= 3600000;
       }
    }
    if( ScanSw(1) ) {
       printf("After.\n");
       pr_rings();
       getch();
    }
}

void clear_rings (void)
{
int i, j;

    for (i = 0; i < NR_LEVELS; i++) {
       Ring[i].nr = Ring[i].last = 0;
       for( j=0; j<NR_CROSS; j++ ) Ring[i].angle[j] = 0;
    }

    Pcross  = 0;
    Cross   = 0;
    Hlvl    = 0;
    Llvl    = 0;
}

long
Im360( register long a )
{
    while( a <        0 )       a += 3600000;
    while( a > 3600000 )        a -= 3600000;
    return  a;
}

pr_rings()
{
register short i, j;

    printf("\n");
    for( i=0; i<NR_LEVELS; i++ ) {
       printf("%d %d:%d", i, Ring[i].nr, Ring[i].last );
       for( j=0; j<NR_CROSS; j++ ) {
          printf(" %d", Ring[i].angle[j] );
       }
       printf("\n");
    }
}

Debug1()
{
long i;
    for( i=1; i<nr_found; i++ ) printf("%3d", A[i].itarget );

    printf("  H=%x L=%x\n", Hlvl, Llvl );
    getch();
}

Debug2()
{
long i;
    for( i=1; i<nr_found; i++ ) printf("%3d", A[i].itarget );

    printf("2:H=%x L=%x\n", Hlvl, Llvl );
  /*    getch();*/
}
```

SPC 227 PA -45-

```
Debug3 ()
{
printf ("Inrlp2\n" );
}

Debug10 ()
{
printf (">");
}

Debug11 ()
{
printf ("<");
}
```

The following is an exemplary software program, to be stored in the computer 62, (4) for performing a setup procedure for installing and subsequently recalibrating the apparatus 50 on a typical earthmoving excavator 10 and (5) computing the coordinates of the reflectors 54–57 relative to the transceiver 52 and the position of the tip of the teeth 30 of bucket 26 relative to the machine 10 and a spacial reference point (i.e., the ground 104):

-47-

```
#pragma hdrfile "EXCAV.SYM
  #include <stdio.h>
  #include <math.h>
  #include <conio.h>
  #include <stdlib.h>
  #include <graphics.h>
#pragma hdrstop

//.....................................................................
FILE *kr,*kw;
#define DEGRAD (M_PI/180.)  // multiplier for degrees to radians
//.....................................................................
// declare variables
//.....................................................................
//.....................................................................
// declare boom, stick and bucket arm lengths + orientation
//.....................................................................
double d12; // distance hinge 1 & 2: effective boom  length
double d23; // distance hinge 2 & 3: effective stick length
double d34; // distance hinge 3 & 4: effective bucket arm length
double d45; // distance hinge 4 & 5: effective bucket arm length
double d56; // distance hinge 5 & 6: effective bucket arm length
double d67; // distance hinge 6 & 7: effective bucket arm length
double p67; // angle between H5-H6 & H6-H7: constant
double d36; // distance hinge 3 & 6: effective bucket arm length
double p36; // angle between H2-H3 & H3-H6: constant
//.....................................................................
// declare positions of CAPSY
//.....................................................................
double dc1; // distance CAPSY (R0) & hinge 1 (H1): constant
double dc2; // distance CAPSY (R0) & hinge 2 (H2): constant
double dc3; // distance CAPSY (R0) & hinge 3 (H3): depends on stick angle
double pc1; // angle between H2-H1 & H1-R0: constant
double pc2; // angle between R0-H2 & H2-H1: constant
double pc3; // angle between R0-H3 & H3-H2: depends on stick angle
//.....................................................................
// declare positions of reflectors
//.....................................................................
double dr1; // distance reflector 1 (R1) & hinge 1 (H1): constant
double dr2; // distance reflector 2 (R2) & hinge 2 (H2): constant
double dr3; // distance reflector 3 (R3) & hinge 3 (H3): constant
double pr1; // angle between +X-axis & R1-H1: constant
double pr2; // angle between H3-H2   & H2-R2: constant
double pr3; // angle between H4-H3   & H3_R3: constant
//.....................................................................
// declare distances from CAPSY to reflectors
//.....................................................................
double d01; // distance CAPSY (R0) & reflector 1 (R1)
double d02; // distance CAPSY (R0) & reflector 2 (R2)
double d03; // distance CAPSY (R0) & reflector 3 (R3)
//.....................................................................
// declare boom, stick and bucket angles
//..................................... ..............................
double pbo_min;       // boom   angle, minimum value
double pbo_max;       // boom   angle, maximum value
double pbo_min_phys ; // boom   angle, minimum value, physical limit
double pbo_max_phys ; // boom   angle, maximum value, physical limit
double pbo_rng;       // boom   angle, range

int  n_pst;     // number of stick angles
```

SPC 227 PA -48-

```
double pst_min;       // stick  angle, minimum value
double pst_max;       // stick  angle, maximum value
double pst_min_phys ; // stick  angle, minimum value, physical limit
double pst_max_phys ; // stick  angle, maximum value, physical limit
double pst_rng;       // stick  angle, range

double pbu_min;       // bucket angle, minimum value
double pbu_max;       // bucket angle, maximum value
double pbu_min_phys ; // bucket angle, minimum value, physical limit
double pbu_max_phys ; // bucket angle, maximum value, physical limit
double pbu_min_math ; // bucket angle, minimum value, mathematical limit
double pbu_max_math ; // bucket angle, maximum value, mathematical limit
double pbu_rng;       // bucket angle, range
//.....................................................................
// declare CAPSY angles with different zero reference
//.....................................................................
int  n_p01;     // number of first CAPSY angles
double p01_min;       // first  angle, minimum value
double p01_max;       // first  angle, maximum value
double p01_rng;       // first  angle, range
int  n_p02;     // number of second CAPSY angles
double p02_min;       // second angle, minimum value
double p02_max;       // second angle, maximum value
double p02_rng;       // second angle, range
int  n_p03;     // number of third CAPSY angles
double p03_min;       // third  angle, minimum value
double p03_max;       // third  angle, maximum value
double p03_rng;       // third  angle, range
//.....................................................................
// declare x-y coordinates
//.....................................................................
double xh1,yh1;       // x-y coordinate hinge 1
double xh2,yh2;       // x-y coordinate hinge 2
double xh3,yh3;       // x-y coordinate hinge 3
double xh4,yh4;       // x-y coordinate hinge 4
double xh5,yh5;       // x-y coordinate hinge 5
double xh6,yh6;       // x-y coordinate hinge 6
double xh7,yh7;       // x-y coordinate hinge 7 (is bucket tip)
//.....................................................................
void dc3_pc3(double pst){
dc3 = sqrt( dc2*dc2 + d23*d23 + 2*dc2*d23*cos(pc2 + pst) ); // eqn 21
pc3 = pst +pc2 -atan2(d23*sin(pst+pc2),dc2 +d23*cos(pst+pc2) );   // eqn 22
}
//.....................................................................
void pbu_min_max_rng (double pst){
double lr3;       // dimensionless distance: dr3 / dc3
dc3_pc3(pst);         // calculate dc3 and pc3
lr3 = dr3 / dc3;      // non dimensional dr3
if(lr3>1.){
  pbu_min = - M_PI;
  pbu_max = + M_PI;
  p03_min = + M_PI;
  p03_max = - M_PI;
}else{
  pbu_min = - pr3 - pc3 - M_PI + acos(lr3);
  pbu_max = - pr3 - pc3 + M_PI - acos(lr3);
  p03_min = - asin(lr3);
  p03_max = + asin(lr3);
}
pbu_rng =   pbu_max - pbu_min;
p03_rng =   p03_max - p03_min;
}
//.....................................................................
void excav_input (void){
int i;
double pbo,pst,pbu;      // boom, stick and bucket angle
double p01,p02,p03;      // CAPSY angles 1,2 and 3
double l01; // dimensionless distance: d01 / dc1
double l02; // dimensionless distance: d02 / dc1
double l03; // dimensionless distance: d03 / dc1
double lr1; // dimensionless distance: dr1 / dc1
double lr2; // dimensionless distance: dr2 / dc2
double lr3; // dimensionless distance: dr3 / dc3
//.....................................................................
```

SPC 227 PA -49-

```
// include excavator dimensions
//.....................................................................
#include "excav.dat"    DATA INPUT FILE AS INCLUDE FILE
//.....................................................................
//      calculate unique boom angle range
//.....................................................................
lr1 = dr1 / dc1;      // lr1: non dimensional dr1
if(lr1>1.){
  pbo_min = - M_PI;
  pbo_max = + M_PI;
  p01_min = - M_PI;
  p01_max = + M_PI;
  fprintf(kw,"\nall boom angles detectable with a single angle measurement"   );
}else{
  pbo_min = pr1 - pc1 - acos(lr1);
  pbo_max = pr1 - pc1 + acos(lr1);
  p01_min = - asin(lr1);
  p01_max = + asin(lr1);
}
pbo_rng = pbo_max - pbo_min;
p01_rng = p01_max - p01_min;
fprintf(kw,
"\nmin/max/rng:boom   %6.1lf %6.1lf %6.1lf //p01= %5.1lf %5.1lf %5.1lf\n"    ,
  pbo_min/DEGRAD,pbo_max/DEGRAD,pbo_rng/DEGRAD,
  p01_min/DEGRAD,p01_max/DEGRAD,p01_rng/DEGRAD);
//.....................................................................
//      calculate CAPSY position for stick angle calculation
//.....................................................................
dc2 = sqrt( dc1*dc1 + d12*d12 - 2.*dc1*d12*cos(pc1) );   // eqn 10
pc2 = atan2( dc1 * sin(pc1)  , d12 - dc1 * cos(pc1) );   // eqn 11
//.....................................................................
//      calculate unique stick angle range
//.....................................................................
lr2 = dr2 / dc2;      // lr1: non dimensional dr1
if(lr2>1.){
  pst_min = - M_PI;
  pst_max = + M_PI;
  p02_min = - M_PI;
  p02_max = + M_PI;
  fprintf(kw,"\nall stick angles detectable with a single angle measurement"   );
}else{
  pst_min = - pr2 - pc2 - M_PI + acos(lr2);
  pst_max = - pr2 - pc2 + M_PI - acos(lr2);
  p02_min = - asin(lr2);
  p02_max = + asin(lr2);
}
  pst_rng =   pst_max - pst_min;
  p02_rng =   p02_max - p02_min;
fprintf(kw,
"\nmin/max/rng:stick  %6.1lf %6.1lf %6.1lf //p02= %5.1lf %5.1lf %5.1lf\n"    ,
  pst_min/DEGRAD,pst_max/DEGRAD,pst_rng/DEGRAD,
  p02_min/DEGRAD,p02_max/DEGRAD,p02_rng/DEGRAD);

//.....................................................................
//      calculate unique bucket arm angle range, depends on stick angle
//.....................................................................
for(i=0;i<=n_pst;i++){
  pst = pst_min + i*pst_rng/n_pst;
  pbu_min_max_rng (pst);        // calculate bucket angles min/max/rng
  if(lr3>1.){
    fprintf(kw,"\nall bucket angles detectable with a single angle measurement"   );
  }
  fprintf(kw,
  "\nmin/max/rng:bucket %6.1lf %6.1lf %6.1lf //p03= %5.1lf %5.1lf %5.1lf //stick:%6.1lf"    ,
  pbu_min/DEGRAD,pbu_max/DEGRAD,pbu_rng/DEGRAD,
  p03_min/DEGRAD,p03_max/DEGRAD,p03_rng/DEGRAD,pst/DEGRAD);
}
//.....................................................................
//      determine limited bucket arm angle range, depends on bucket arm lengths
//.....................................................................
if( d34 + d45 < d36 + d56 ){
  pbu_max_math =p36+acos((d34*d34 +d36*d36-(d45+d56)*(d45+d56))/(2.*d34*d36));// eqn 32
  pbu_min_math =p36-acos((d34*d34 +d36*d36-(d45+d56)*(d45+d56))/(2.*d34*d36));// eqn 32
  fprintf(kw,"\nbucket arm lengths permit limited rotation ofñ%6.1 deg"   ,
```

```
  pbu_max_math /DEGRAD );
}else{
  pbu_min_math  = - M_PI;
  pbu_max_math  = + M_PI;
}
fprintf (kw,"\n\nmin/max:bucket math %6.11f %6.11f\n"  ,
        pbu_min_math /DEGRAD,pbu_max_math /DEGRAD);
                    // adapt pbu_min if necessary
if(pbu_min_phys  < p36)            pbu_min_phys  = p36;
                    // adapt pbu_max if necessary
if(pbu_max_phys  > p36 + M_PI)    pbu_max_phys  = p36 + M_PI;                    // eqn 34
if(pbu_max_phys  > pbu_max_math ) pbu_max_phys  = pbu_max_math ;

fprintf (kw,"\nmin/max:boom   phys %6.11f %6.11f"  ,
    pbo_min_phys /DEGRAD,pbo_max_phys /DEGRAD);
fprintf (kw,"\nmin/max:stick  phys %6.11f %6.11f"  ,
    pst_min_phys /DEGRAD,pst_max_phys /DEGRAD);
fprintf (kw,"\nmin/max:bucket phys %6.11f %6.11f"  ,
    pbu_min_phys /DEGRAD,pbu_max_phys /DEGRAD);
}
//.......................................................................
double pbo_p01 (       // calculate boom angle from
double p01){               // first CAPSY angle
double l01;     // dimensionless distance: d01 / dc1
double lr1;     // dimensionless distance: dr1 / dc1
double x,y;
lr1 = dr1 / dc1;  // lr1: non dimensional dr1
l01 = cos(p01) -sqrt( cos(p01)*cos(p01) +lr1*lr1 -1.);   // eqn 4
x =-(l01 * cos(p01) -1.);
y =  l01 * sin(p01);
return atan2(y,x) -pc1 +pr1;            // eqn 5
}
//.......................................................................
double p01_pbo (       // calculate first CAPSY angle from
double pbo){       // boom angle
double l01;     // dimensionless distance: d01 / dc1
double lr1;     // dimensionless distance: dr1 / dc1
double x,y,psi;
lr1 = dr1 / dc1;  // lr1: non dimensional dr1
psi = +pc1 +pbo -pr1;
x =-(lr1 * cos(psi) -1.);
y =  lr1 * sin(psi);
return atan2(y,x);   // first CAPSY angle    // eqn 7
}
//.......................................................................
//.......................................................................
double pst_p02 (       // calc stick angle from
double p02){       // second CAPSY angle
double l02;     // dimensionless distance: d02 / dc1
double lr2;     // dimensionless distance: dr2 / dc2
double x,y,psi;
//.......................................................................
//      calculate CAPSY position for stick angle calculation
//.......................................................................
dc2 = sqrt( dc1*dc1 + d12*d12 - 2.*dc1*d12*cos(pc1) );   // eqn 10
pc2 = atan2( dc1 * sin(pc1)   , d12 - dc1 * cos(pc1) );   // eqn 11
lr2 = dr2 / dc2;      // lr1: non dimensional dr1
//.......................................................................
l02 = cos(p02) + sqrt( cos(p02)*cos(p02) +lr2*lr2 -1.);  // eqn 15
x = l02 * cos(p02) -1.;
y = l02 * sin(p02);
return atan2(y,x) -pc2 -pr2;            // eqn 16
}
//.......................................................................
double p02_pst (       // calculate second CAPSY angle from
double pst){       // stick angle
double lr2;     // dimensionless distance: dr2 / dc2
double x,y,psi;
//.......................................................................
//      calculate CAPSY position for stick angle calculation
//.......................................................................
dc2 = sqrt( dc1*dc1 + d12*d12 - 2.*dc1*d12*cos(pc1) );   // eqn 10
pc2 = atan2( dc1 * sin(pc1)   , d12 - dc1 * cos(pc1) );   // eqn 11
lr2 = dr2 / dc2;  // lr1: non dimensional dr1
```

```
//.....................................................................
psi = pc2 + pst + pr2;
x = lr2 * cos(psi) +1.;
y = lr2 * sin(psi);
return atan2(y,x);   // return calculated p02   // eqn 18
}
//.....................................................................
double pbu_p03(          // calc stick angle from
double p02 , double p03){  // second and third CAPSY angle
double x,y;
double pst;
double l03;        // dimensionless distance: d03 / dc1
double lr3;        // dimensionless distance: dr3 / dc3
pst = pst_p02(p02);      // calc stick angle & position CAPSY first
dc3_pc3(pst);         // calculate dc3 and pc3
lr3 = dr3 / dc3;      // lr1: non dimensional dr1, depends on p02
l03 = cos(p03) + sqrt( cos(p03)*cos(p03) +lr3*lr3 -1.);  // distance R0-R3
x = l03 * cos(p03) -1.;
y = l03 * sin(p03);
return atan2(y,x) -pc3 -pr3;     // return bucket angle
}
//.....................................................................
double p03_pbu(          // calc third CAPSY angle from
double pst , double pbu){  // stick and bucket angle
double x,y;
double lr3;        // dimensionless distance: dr3 / dc3
dc3_pc3(pst);         // calculate dc3 and pc3
lr3 = dr3 / dc3;      // lr1: non dimensional dr1, depends on pst
x = lr3 * cos(pc3 +pbu +pr3) +1.;
y = lr3 * sin(pc3 +pbu +pr3);
return atan2(y,x);
}
int kp;
//.....................................................................
void xy_from_capsy_angles (
double p01,double p02,double p03){  // CAPSY angles 1,2 and 3
double pbo,pst,pbu;          // boom, stick and bucket angle
double alp,bet;
double psi,d46;
pbo = pbo_p01(p01);  // calc boom   angle from 1-st CAPSY angle
pst = pst_p02(p02);  // calc stick  angle from 2-nd CAPSY angle
pbu = pbu_p03(p02,p03); // calc bucket angle from 2-nd & 3-rd CAPSY angle

xh1 = 0;            // x-coordinate H1
yh1 = 0;            // y-coordinate H1
xh2 = d12 * cos(pbo);          // x-coordinate H2   // eqn 8
yh2 = d12 * sin(pbo);          // y-coordinate H2   // eqn 9
xh3 = xh2 + d23 * cos(pbo+pst);      // x-coordinate H3   // eqn 19
yh3 = yh2 + d23 * sin(pbo+pst);      // y-coordinate H3   // eqn 20
xh4 = xh3 + d34 * cos(pbo+pst+pbu); // x-coordinate H4   // eqn 30
yh4 = yh3 + d34 * sin(pbo+pst+pbu); // y-coordinate H4   // eqn 31
xh6 = xh3 + d36 * cos(pbo+pst+p36); // x-coordinate H6   // eqn 38
yh6 = yh3 + d36 * sin(pbo+pst+p36); // y-coordinate H6   // eqn 39
psi = pbu - p36;
if(fabs(psi)<0.001) psi= (psi>0) ? 0.001 : -0.001; // prevent atan(0,0)
d46 = sqrt(   d34*d34 + d36*d36 - 2.*d34*d36*cos(psi) ); // eqn 35
alp = atan2 ( d34 * sin(psi)  ,  d36 - d34 * cos(psi) ); // eqn 36
// beta mbv acos niet waterdicht (zou met arctg moeten), nu: 0 < beta < 180
bet = acos ( ( d46*d46 + d56*d56 - d45*d45) / ( 2.*d46*d56 ) );   // eqn 37
psi = M_PI - alp - bet;
xh5 = xh6 + d56 * cos(pbo+pst+psi); // x-coordinate H5   // eqn 40
yh5 = yh6 + d56 * sin(pbo+pst+psi); // y-coordinate H5   // eqn 41
psi = p67 - alp - bet;
xh7 = xh6 + d67 * cos(pbo+pst+psi); // x-coordinate H7   // eqn 42
yh7 = yh6 + d67 * sin(pbo+pst+psi); // y-coordinate H7   // eqn 43

if(kp)
fprintf(kw,"\n pbo pst pbu alp bet: %7.1lf %7.1lf %7.1lf %7.1lf %7.1lf"   ,
pbo/DEGRAD,pst/DEGRAD,pbu/DEGRAD,alp/DEGRAD,bet/DEGRAD);
}
//.....................................................................
//.....................................................................
void main (void){
int i,j,k;
```

```
int ii,jj,kk;
double pbo,pst,pbu;      // boom, stick and bucket angle
double p01,p02,p03;      // CAPSY angles 1,2 and 3

double x,dx,dx_max=0,dx_min=99999.,dx_dp01,dx_dp02,dx_dp03;
double y,dy,dy_max=0,dy_min=99999.,dy_dp01,dy_dp02,dy_dp03;
double p01_dx_max,p02_dx_max,p03_dx_max,p01_dx_min,p02_dx_min,p03_dx_min;
double p01_dy_max,p02_dy_max,p03_dy_max,p01_dy_min,p02_dy_min,p03_dy_min;
double pbo_dx_max,pst_dx_max,pbu_dx_max,pbo_dx_min,pst_dx_min,pbu_dx_min;
double pbo_dy_max,pst_dy_max,pbu_dy_max,pbo_dy_min,pst_dy_min,pbu_dy_min;
double dp;

//  if((kr=fopen("EXCAV.INP.INP","rt"))==NULL){ // implement later
//    fprintf(kw,"\nCannot open  input file");
//    exit(1);
//  }

if((kw=fopen("EXCAV.OUT","wt"))==NULL){
  printf("\nCannot open output file" );
  exit(1);
}
excav_input();
dp= 0.01 * DEGRAD;       // maximum error CAPSY angle measurement

for(i=0;i<=n_p01;i++){
  p01 = p01_min + i*p01_rng/n_p01;
  if(i==0 || i==n_p01) p01*=0.99;   // keep p01 inside range
  pbo = pbo_p01(p01);

  if( fabs(p01_pbo(pbo)-p01)>0.00001){
    fprintf(kw,"\n error: check function p01_pbo" );
    exit(1);
  }
  if( fabs(pbo_p01(p01)-pbo)>0.00001){
    fprintf(kw,"\n error: check function pbo_p01" );
    exit(1);
  }

  if(pbo<pbo_max_phys && pbo>pbo_min_phys){
    for(j=0;j<=n_p02;j++){
      p02 = p02_min + j*p02_rng/n_p02;
      if(j==0 || j==n_p02) p02*=0.99;  // keep p02 inside range
      pst = pst_p02(p02);  // calc stick  angle from 2-nd CAPSY angle

      if( fabs(p02_pst(pst)-p02)>0.00001){
   fprintf(kw,"\n error: check function p02_pst" );
   exit(1);
      }
      if( fabs(pst_p02(p02)-pst)>0.00001){
   fprintf(kw,"\n error: check function pst_p02" );
   exit(1);
      }

      if(pst<pst_max_phys && pst>pst_min_phys){
   pbu_min_max_rng(pst);   // calculate bucket angle min/max/rng

   for(k=0;k<=n_p03;k++){
     p03 = p03_min + k*p03_rng/n_p03;  // keep p03 inside range
     if(k==0 || k==n_p03) p03*=0.99;

     pbu = pbu_p03(p02,p03);  // calc bucket angle from 2-nd & 3-rd CAPSY angle

     if( fabs(p03_pbu(pst,pbu)-p03)>0.00001){
       fprintf(kw,"\n error: check function p03_pbu" );
       exit(1);
     }
     if( fabs(pbu_p03(p02,p03)-pbu)>0.00001){
       fprintf(kw,"\n error: check function pbu_p03" );
       exit(1);
     }

     if(pbu<pbu_max_phys && pbu>pbu_min_phys ){
       kp=1;              // output indicator
       xy_from_capsy_angles(p01   ,p02   ,p03);
```

SPC 227 PA -53-

```
        x=xh4; y=yh4;
        kp=0;
        xy_from_capsy_angles (p01+dp,p02    ,p03    );
        dx_dp01=fabs(x-xh4);
        dy_dp01=fabs(y-yh4);

        xy_from_capsy_angles (p01    ,p02+dp,p03    );
        dx_dp02=fabs(x-xh4);
        dy_dp02=fabs(y-yh4);

        xy_from_capsy_angles (p01    ,p02    ,p03+dp);
        dx_dp03=fabs(x-xh4);
        dy_dp03=fabs(y-yh4);

        dx=dx_dp01+dx_dp02+dx_dp03;
        dy=dy_dp01+dy_dp02+dy_dp03;

        if(dx>dx_max){
          p01_dx_max=p01; p02_dx_max=p02; p03_dx_max=p03;
          pbo_dx_max=pbo; pst_dx_max=pst; pbu_dx_max=pbu;
          dx_max=dx;
        }
        if(dy>dy_max){
          p01_dy_max=p01; p02_dy_max=p02; p03_dy_max=p03;
          pbo_dy_max=pbo; pst_dy_max=pst; pbu_dy_max=pbu;
          dy_max=dy;
        }
        if(dx<dx_min){
          p01_dx_min=p01; p02_dx_min=p02; p03_dx_min=p03;
          pbo_dx_min=pbo; pst_dx_min=pst; pbu_dx_min=pbu;
          dx_min=dx;
        }
        if(dy<dy_min){
          p01_dy_min=p01; p02_dy_min=p02; p03_dy_min=p03;
          pbo_dy_min=pbo; pst_dy_min=pst; pbu_dy_min=pbu;
          dy_min=dy;
        }
      }          // endif pbu outside physical range
    }         // endfor pbu loop
      }            // endif pst outside physical range
    }          // endfor pst loop
  }            // endif pbo outside physical range
}          // endfor pbo loop

fprintf(kw,"\n\ndx_max:p01 p02 p03= %6.1lf %6.1lf %6.1lf //dx_max= %6.1lf"   ,
        p01_dx_max/DEGRAD,p02_dx_max/DEGRAD,p03_dx_max/DEGRAD,dx_max);
fprintf(kw,"\ndx max:pbo pst pbu= %6.1lf %6.1lf %6.1lf //dx_max= %6.1lf\n"   ,
        pbo_dx_max/DEGRAD,pst_dx_max/DEGRAD,pbu_dx_max/DEGRAD,dx_max);

fprintf(kw,"\ndy_max:p01 p02 p03= %6.1lf %6.1lf %6.1lf //dy_max= %6.1lf"   ,
        p01_dy_max/DEGRAD,p02_dy_max/DEGRAD,p03_dy_max/DEGRAD,dy_max);
fprintf(kw,"\ndy max:pbo pst pbu= %6.1lf %6.1lf %6.1lf //dy_max= %6.1lf\n"   ,
        pbo_dy_max/DEGRAD,pst_dy_max/DEGRAD,pbu_dy_max/DEGRAD,dy_max);


fprintf(kw,"\ndx_min:p01 p02 p03= %6.1lf %6.1lf %6.1lf //dx_min= %6.1lf"   ,
        p01_dx_min/DEGRAD,p02_dx_min/DEGRAD,p03_dx_min/DEGRAD,dx_min);
fprintf(kw,"\ndx_min:pbo pst pbu= %6.1lf %6.1lf %6.1lf //dx_min= %6.1lf\n"   ,
        pbo_dx_min/DEGRAD,pst_dx_min/DEGRAD,pbu_dx_min/DEGRAD,dx_min);

fprintf(kw,"\ndy_min:p01 p02 p03= %6.1lf %6.1lf %6.1lf //dy_min= %6.1lf"   ,
        p01_dy_min/DEGRAD,p02_dy_min/DEGRAD,p03_dy_min/DEGRAD,dy_min);
fprintf(kw,"\ndy_min:pbo pst pbu= %6.1lf %6.1lf %6.1lf //dy_min= %6.1lf\n"   ,
        pbo_dy_min/DEGRAD,pst_dy_min/DEGRAD,pbu_dy_min/DEGRAD,dy_min);

fprintf(kw,"\n");
fclose(kw);
}
```

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. An apparatus for determining a position of a tool mounted on a machine, said machine including a base, an arm having a plurality of pivot points with a rear end pivotally attached to said base at one pivot point and a leading end pivotally attached to said tool at another pivot point, and at least one actuating mechanism for pivotally moving said arm and for pivotally moving said tool, said apparatus comprising:

a plurality of reflectors mounted on and in a known relationship to said machine for indicating movement of said arm and said tool, each of said reflectors being operatively adapted for reflecting light back toward a light source;

a light transceiver mounted on said machine in a known relationship to said plurality of reflectors and operatively adapted for transmitting a beam of light to illuminate each of said reflectors and to generate reflected light from each of said reflectors, detecting said reflected light and the angular orientation of said reflected light with respect to an index position, and generating at least one output signal in response to detecting said reflected light and the angular orientation of said reflected light with respect to said index position, and a computer operatively adapted for determining the position of said tool from a plurality of said output signal.

2. The apparatus as recited in claim 1, wherein said computer is operatively adapted to compute an angular relationship between each of said reflectors and said light transceiver from a plurality of said output signal and then determine the position of said tool from said angular relationship.

3. The apparatus as recited in claim 1, wherein said computer is operatively adapted to compute the position of said tool using the known relationship between said light transceiver and said plurality of reflectors.

4. The apparatus as recited in claim 1, wherein each of said plurality of reflectors and said light transceiver is mounted on said machine in a known geometric relationship to at least one of said plurality of pivot points, and said computer is operatively adapted to compute the position of said tool using the known geometric relationship between said light transceiver, said reflectors and said pivot points.

5. The apparatus as recited in claim 1, wherein each reflector is operatively adapted for encoding light reflected therefrom to uniquely identify one reflector from another.

6. The apparatus as recited in claim 1, wherein said light transceiver is mounted on the arm of said machine.

7. The apparatus as recited in claim 1, wherein said light transceiver is mounted on the base of said machine.

8. The apparatus as recited in claim 1, wherein at least one of said plurality of reflectors is mounted on said arm so as to be rotatable about at least one of said pivot points and thereby describe at least part of a circle, and said light transceiver is positioned on said machine within said circle.

9. The apparatus as recited in claim 1, wherein said apparatus further comprises a display for visually displaying the position of said tool in response to tool position computations.

10. The apparatus as recited in claim 1, wherein said apparatus further comprises a reference measuring system for determining the location of said machine relative to a spacial reference point, wherein said computer is adapted for computing the position of said tool relative to the spatial reference point from said output signal generated in response to said reflected light, the angular orientation of said reflected light, and a location measurement of said machine from said reference measuring system.

11. The apparatus as recited in claim 10, wherein said machine is construction equipment, the spacial reference point is a reference elevation, and said reference measuring system is a level reference laser system for measuring the elevation of a point on said construction equipment relative to the reference elevation, said level reference laser system comprising a receiver mounted at a known relationship to the point on said construction equipment for detecting laser light from a source of laser light and a reference laser positioned remotely from said construction equipment for transmitting a plane of laser light to illuminate said receiver at a known distance above the reference elevation, said receiver being operatively adapted for generating an output signal in response to the laser light from said reference laser indicating the position of the point on said construction equipment relative to the reference elevation, and said computer is adapted for also computing the position of said tool relative to the reference elevation using the output signal generated by said receiver in response to the laser light from said reference laser.

12. The apparatus as recited in claim 11, wherein an inclination sensor is mounted on said construction equipment for providing said computer with the angle of said construction equipment relative to said plane of laser light, and said computer is adapted for also computing the position of said tool relative to the reference elevation using the angle of said construction equipment provided by said inclination sensor.

13. The apparatus as recited in claim 10, wherein said machine is a type of construction equipment, said reference measuring system is a global positioning system operatively adapted for making at least elevation determinations about said construction equipment by providing said computer with a signal indicative of the position of a point on said construction equipment relative to the spacial reference point.

14. The apparatus as recited in claim 1, wherein said apparatus further comprises a reference ruler having a length with three targets spaced a known distance apart along said length, said reference ruler being used in determining at least one dimensional relationship between said light transceiver and the arm of the machine, without having to actually measure the relationship.

15. An apparatus for determining a position of a bucket mounted on an earthmoving machine relative to a grade elevation, said earthmoving machine including a platform, an arm with a plurality of pivot points, a rear end pivotally attached to said platform at one of said pivot points and a leading end pivotally attached to said bucket at another of said pivot points, and at least one actuating mechanism for pivotally moving said arm and for pivotally moving said bucket, said apparatus comprising:

a plurality of reflectors mounted on and in a known relationship to said machine, each of said plurality of reflectors being operatively adapted for reflecting light back toward a light source, and said plurality of reflectors including at least one reflector mounted on said earthmoving machine for indicating movement of said arm and another reflector mounted on said earthmoving machine for indicating movement of said bucket;

a laser transceiver mounted on said earthmoving machine in a known relationship to at least one of said plurality of reflectors and said pivot points and operatively adapted for transmitting a beam of laser light to illuminate each of said plurality of reflectors and thereby generate reflected laser light from each of said plurality of reflectors, detecting said reflected laser light and the angular orientation of said reflected laser light with respect to an index position, generating at least one output signal in response to detecting said reflected laser light and the angular orientation of said reflected laser light with respect to said index position; and a computer for computing the position of said bucket relative to the grade elevation from a plurality of said output signal.

16. The apparatus as recited in claim 15, wherein said arm includes a first arm segment and a second arm segment, said plurality of pivot points includes a first, second and third pivot point, said first arm segment has a rear end pivotally attached to said platform at said first pivot point and a leading end, said second arm segment has a rear end pivotally attached to the leading end of said first arm segment at said second pivot point and a leading end pivotally attached to said bucket at said third pivot point, and said earthmoving machine includes at least one actuating mechanism for pivoting said first arm segment about said first pivot point, at least one actuating mechanism for pivoting said second arm segment about said second pivot point, and at least one actuating mechanism for pivoting said bucket about said third pivot point, and said at least one reflector includes at least one first reflector for indicating movement of said first arm segment and a second reflector for indicating movement of said second arm segment, said other reflector includes a third reflector for indicating movement of said bucket, and said laser transceiver is mounted on one of said first arm segment and said second arm segment.

17. The apparatus as recited in claim 16, wherein said laser transceiver is mounted on said first arm segment, said at least one first reflector is mounted on said platform, said second reflector is mounted so as to rotate with said second arm segment and said third reflector is mounted to move as said bucket rotates.

18. The apparatus as recited in claim 16, wherein said laser transceiver is mounted on said first arm segment, said at least one first reflector includes two first reflectors, one of said first reflectors is at an elevated position above the other of said first reflectors, said second reflector is mounted so as to rotate with said second arm segment, and said third reflector is mounted to move as said bucket rotates.

19. The apparatus as recited in claim 15, wherein said laser transceiver is mounted on the platform of said earthmoving machine.

20. The apparatus as recited in claim 15, wherein said arm includes a plurality of arm segments, each of said arm segments being rotatable about one of said pivot points, said at least one reflector includes a rotatable reflector mounted so as to rotate with at least one of said arm segments, said other reflector is another rotatable reflector mounted to move as said bucket rotates, each said rotatable reflector is rotated so as to describe at least part of a circle, and said laser transceiver is positioned on said earthmoving machine within said circle.

21. An apparatus for determining a position of a bucket mounted on an earthmoving machine relative to a grade elevation, said earthmoving machine including a platform, an arm having a first arm segment, a second arm segment and a plurality of pivot points, said first arm segment having a rear end pivotally attached to said platform at a first pivot point and a leading end, said second arm segment having a rear end pivotally attached to the leading end of said first arm segment at a second pivot point and a leading end pivotally attached to said bucket at a third pivot point, and said earthmoving machine including at least one actuating mechanism for pivoting said first arm segment about said first pivot point, at least one actuating mechanism for pivoting said second arm segment about said second pivot point, and at least one actuating mechanism for pivoting said bucket about said third pivot point, said apparatus comprising:

a plurality of retroreflectors, including at least one first retroreflector mounted on said platform for indicating movement of said first arm segment, a second retroreflector mounted so as to rotate with said second arm segment, and a third retroreflector mounted to move as said bucket rotates, each of said retroreflectors being mounted on said machine in a known relationship to at least one of said plurality of pivot points and being operatively adapted for reflecting light back toward a light source;

a laser transceiver mounted on said first arm segment in a known relationship to each of said retroreflectors and pivot points, said laser transceiver including a transmitter for transmitting a rotating beam of laser light to illuminate each of said retroreflectors and thereby generate reflected laser light from each of said retroreflectors during each rotation of said beam of laser light, and a detector for detecting said reflected laser light and the angular orientation of said reflected laser light with respect to an index position, and said laser transceiver being operatively adapted for generating at least one output signal in response to detecting said reflected laser light and the corresponding angular orientation;

a reference measuring system for measuring the elevation of a point on said earthmoving machine relative to the grade elevation; and a computer operatively adapted for determining the position of said bucket relative to the grade elevation from a plurality of said output signal and an elevation measurement from said reference measuring system of the point on said earthmoving machine.

22. The apparatus as recited in claim 21, wherein said at least one first retroreflector includes two first retroreflectors, one of said first retroreflectors is mounted adjacent said first pivot point and the other of said first retroreflectors is mounted at an elevated position above said first pivot point.

23. The apparatus as recited in claim 21, wherein each of said second and third retroreflectors is rotatable about at least one of said pivot points so as to describe at least part of a circle, and said laser transceiver is positioned on said first arm segment so as to remain within said circle during the operation of said earthmoving machine.

24. A method of determining a position of a tool mounted on a machine having a base, an arm with a plurality of pivot points, a rear end pivotally attached to the base at one pivot point and a leading end pivotally attached to the tool at another pivot point, and at least one actuating mechanism for pivotally moving the arm and for pivotally moving the tool, said method comprising the steps of:

transmitting a beam of light at a plurality of light reflectors mounted on the machine in a known relationship to one another;

illuminating each of the reflectors with the beam of light;

generating reflected light when each of the reflectors is illuminated with the beam of light;

detecting the reflected light and the angular orientation of the reflected light from each of the reflectors;

generating at least one output signal in response to detecting the reflected light and the corresponding angular orientation from each of the reflectors: and determining the position of the tool using a plurality of the output signals generated.

25. The method as recited in claim 24, wherein the step of determining the position of the tool includes the steps of:

providing a light transceiver for transmitting the beam of light, computing an angular relationship between each of the reflectors and the light transceiver from a plurality of the output signals, and then determining the position of the tool using the computed angular relationship.

26. The method as recited in claim 24, wherein said method includes the steps of:

providing a light transceiver for transmitting the beam of light, and using a known relationship between the light transceiver and the reflectors in determining the position of the tool.

27. The method as recited in claim 24, wherein said method includes the steps of:

providing a light transceiver for transmitting the beam of light, performing a setup procedure to determine at least one dimensional relationship between the light transceiver and at least one of a reflector and the arm of the machine, without measuring the at least one dimensional relationship; and using the at least one dimensional relationship in determining the position of the tool.

28. The method as recited in claim 24, wherein said method includes the steps of:

providing a reference ruler having a length with at least three targets spaced a known distance apart along the length;

determining, without measuring, at least one dimensional relationship between the light transceiver and at least one of a reflector and the arm of the machine by using the reference ruler and the light transceiver; and using the at least one dimensional relationship in determining the position of the tool.

* * * * *